US007262548B2

(12) United States Patent
Ito

(10) Patent No.: US 7,262,548 B2
(45) Date of Patent: Aug. 28, 2007

(54) IMAGE FORMING APPARATUS CAPABLE OF SUPPRESSING A FLUCTUATION IN AN INCIDENT POSITION OF AN ELECTRON BEAM

(75) Inventor: Nobuhiro Ito, Kanagawa-Ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 52 days.

(21) Appl. No.: 11/289,698

(22) Filed: Nov. 30, 2005

(65) Prior Publication Data

US 2006/0145581 A1 Jul. 6, 2006

(30) Foreign Application Priority Data

Dec. 15, 2004 (JP) ..... 2004-362435

(51) Int. Cl.
*H01J 1/62* (2006.01)

(52) U.S. Cl. ..... 313/292; 313/495

(58) Field of Classification Search ..... 313/292, 313/495–497, 238

See application file for complete search history.

(56) References Cited

U.S. PATENT DOCUMENTS

| | | | | |
|---|---|---|---|---|
| 5,614,781 | A | 3/1997 | Spindt et al. | 313/422 |
| 5,742,117 | A | 4/1998 | Spindt et al. | 313/422 |
| 5,990,614 | A | 11/1999 | Spindt | 313/495 |
| 6,002,198 | A | 12/1999 | Spindt et al. | 313/292 |
| 6,600,263 | B1 | 7/2003 | Ito | 313/495 |
| 6,693,376 | B1 | 2/2004 | Ito et al. | 313/495 |
| 6,761,606 | B2 | 7/2004 | Ito et al. | 445/24 |
| 6,809,469 | B1 | 10/2004 | Ito et al. | 313/495 |
| 6,847,161 | B2 | 1/2005 | Ito | 313/495 |
| 6,927,533 | B1 | 8/2005 | Ito et al. | 313/495 |
| 6,991,507 | B2 | 1/2006 | Ito et al. | 445/24 |
| 2004/0071006 | A1 | 4/2004 | Ito et al. | 365/118 |
| 2005/0253068 | A1 | 11/2005 | Ito et al. | 250/310 |

OTHER PUBLICATIONS

JSME Data Book: Heat Transfer 4th Edition, The Japanese Society of Mechanical Engineers, 1986, p. 5.

*Primary Examiner*—Joseph Williams
(74) *Attorney, Agent, or Firm*—Fitzpatrick, Cella, Harper & Scinto

(57) ABSTRACT

The invention is to provide a flat panel image forming apparatus capable of suppressing a fluctuation in an incident position of an electron beam resulting from a front-rear temperature difference generated in a panel, thereby capable of high-quality display not affected by such temperature difference. An image forming apparatus comprises a face plate and a rear plate supported by a spacer, wherein a heat resistance division ratio in a heat conduction, path from the face plate to the rear plate is suppressed to 0.5 or less, to reduce an electrical resistance distribution on the spacer surface which results from a temperature distribution in a direction of height of the spacer thereby suppressing a fluctuation in the incident position of the electron beam from an electron emitting device to an anode.

18 Claims, 14 Drawing Sheets

IMAGE FORMING APPARATUS CAPABLE OF SUPPRESSING A FLUCTUATION IN AN INCIDENT POSITION OF AN ELECTRON BEAM

BACKGROUND OF THE INVENTION

1. Field of the Invention

The present invention relates to an image forming apparatus such as an image display apparatus of flat panel type, utilizing an electron emitting device.

2. Related Background Art

In the image display apparatus including a cathode ray tube, a larger image size is requested, and a thinner structure and a lighter weight in such larger image size of the apparatus are becoming important issues. As an image display apparatus capable of realizing such thinner and lighter structure, the present applicant proposes an image display apparatus of flat panel type, utilizing a surface conduction electron emitting device. Such image display apparatus is formed as a vacuum container by seal bonding a rear plate, provided with plural electron emitting devices, and a face plate, provided with a light emitting member (for example phosphor) capable of emitting light by an electron beam irradiation and an anode electrode, across a frame member. In such image display apparatus, in order to prevent a deformation or a destruction of the plates by a pressure difference between the interior of the vacuum container constituting the display panel and the exterior, a pressure-resistant member, called a spacer, is positioned between the plates. Such spacer usually has a shape of a rectangular thin plate, of which end portions are positioned in contact with the both plates in such a manner that the surface of the spacer becomes parallel to a normal line to the plates.

In driving a display panel, a temperature fluctuation may be generated within the panel. Factors for such temperature fluctuation may be (1) an image source to be displayed, (2) an environment of use, and (3) a deficient heat conductance within a panel casing. More detailed causes of such fluctuation include generation and absorption of Joule's heat in an electron source, matrix wirings, a drive circuit etc., a heat generation by the phosphor, a temperature difference between the ambient temperature and various parts of the panel, and a radiant heat exchange for example by sunlight. Since these parameters are not constant in time and in space, the temperature distribution in the panel is generated not only along the planar direction thereof but also on an external surface of the face plate and the rear plate. Such temperature distribution, through dependent on an environment of use and an image to be displayed, causes a temperature difference of 5 to 20° C., typically about 10° C.

In case the temperature is higher in the face plate than in the rear plate in the vicinity of a spacer, an incident position of the electron beam is shifted in a direction attracted by the spacer. On the other hand, in case the temperature is lower in the face plate than in the rear plate, the position of the electron beam changes in a direction farther away from the spacer. A variation in the incident position of the electron beam, though dependent on a pixel pitch, amounts to −0.1 to 0.1 pixel pitch, in case of a pixel pitch of 0.6 mm and a temperature difference of 10° C., thereby significantly deteriorating the display quality.

For suppressing a fluctuation in the incident position of the electron beam in the vicinity of the spacer, resulting from such temperature difference between the front and rear sides of the panel, a technology is disclosed in a patent reference 1, which describes suppression of the fluctuation in the electron beam position resulting from the temperature difference between the front and rear sides of the panel, by selecting a thermal conductivity of the spacer member, a temperature dependence of a resistance thereof, a ratio of a cross section of the spacer and an area of display, and a height of the spacer within desired ranges.

Patent Reference 1: U.S. Pat. No. 5,990,614

A spacer of a high performance has to meet following requirements:

- a strength and a shape capable of withstanding the atmospheric pressure;
- a uniform potential distribution for designing a static potential standard;
- an antistatic structure for designing a dynamic potential standard; and
- a resistance designing for suppressing an electric power consumption.

It is extremely difficult to meet all these requirements with a single material. For this reason, there have been employed various methods such as forming surface irregularities, covering an insulating substrate with a high resistance film, or patterning films different in a secondary electron emission coefficient. It is also required to solve the problems such as "chemical stability", "suppression of degassing", "cost" and "ease of handling in manufacture". It is therefore desired to support required design parameters, as far as possible, by parts other than the spacer.

SUMMARY OF THE INVENTION

An object of the present invention is to suppress, in case a temperature difference is generated between a face plate and a rear plate, a fluctuation in an incident position of an electron beam in the vicinity of a spacer, thereby providing an image forming apparatus of a high display quality, not influenced by such temperature difference. Another object is to provide a separate control parameter, other than the spacer, for suppressing the fluctuation in the incident position of the electron beam, thereby providing an inexpensive image forming apparatus.

In a first aspect, the present invention provides an image forming apparatus including a rear plate provided with plural electron emitting devices and wirings for applying a voltage to the electron emitting devices, a face plate opposed to the rear plate and provided with a light emitting member capable of light emission by an irradiation with an electron beam emitted from the electron emitting devices and an anode electrode, a frame member provided between peripheral portions of the rear plate and the face plate and constituting a vacuum container together with the rear plate and the face plate, and a spacer positioned in contact with the rear plate and the face plate and set at a potential defined by a current field, wherein $\Psi_0 \times \Psi_2$ in a following general equation (1) has a positive value not exceeding 0.05.

$$\frac{\Delta x}{Py} = \Psi_0 \times \Psi_2 \left( \frac{eEa}{kT^2} \frac{h}{Py} \right) \Delta T_1 \tag{1}$$

wherein:

$\Delta x$: displacement [m] of an incident position of an electron beam in the vicinity of spacer;

Py: pitch [m] of electron emitting devices in a direction perpendicular to a spacer surface;

e: unit charge [C];

Ea: activation energy [eV] of a resistance of a spacer;

h: height of a spacer [m];

k: Boltzmann constant [J/K];

T: average external surface temperature [K] of face plate and rear plate;

$\Psi_0$: heat resistance division ratio of spacer represented by a following general equation (2):

$$\Psi_0=Rh_{sp}/(Rh_{cfp}+Rh_{sp}+Rh_{crp}) \quad (2)$$

$Rh_{cfp}$: heat resistance between spacer and face plate [$m^2$ K/W];

$Rh_{sp}$: heat resistance of spacer [$m^2$ K/W];

$Rh_{crp}$: heat resistance between spacer and rear plate [$m^2$ K/W];

$\Psi_2$: spacer sensitivity represented by a following general equation (3):

$$\Psi_2=\gamma/20 \quad (3)$$

$\gamma$: spacer field influence coefficient represented by $h/x_0$;

$x_0$: influence range of spacer electric field [m].

In a second aspect, the present invention provides an image forming apparatus including a rear plate provided with plural electron emitting devices and wirings for applying a voltage to the electron emitting devices, a face plate opposed to the rear plate and provided with a light emitting member capable of light emission by an irradiation with an electron beam emitted from the electron emitting devices and an anode electrode, a frame member provided between peripheral portions of the rear plate and the face plate and constituting a vacuum container together with the rear plate and the face plate, and a spacer positioned in contact with the rear plate and the face plate and set at a potential defined by a current field, wherein a spacer heat resistance division ratio $\Psi_0$ represented by a following general equation (2) has a positive value not exceeding 0.5:

$$\Psi_0=Rh_{sp}/(Rh_{cfp}+Rh_{sp}+Rh_{crp}) \quad (2)$$

wherein:

$Rh_{cfp}$: heat resistance between spacer and face plate [$m^2$ K/W];

$Rh_{sp}$: heat resistance of spacer [$m^2$ K/W];

$Rh_{crp}$: heat resistance between spacer and rear plate [$m^2$K/W].

In a third aspect, the present invention provides an image forming apparatus including a rear plate provided with plural electron emitting devices and wirings for applying a voltage to the electron emitting devices, a face plate opposed to the rear plate and provided with a light emitting member capable of light emission by an irradiation with an electron beam emitted from the electron emitting devices and an anode electrode, a frame member provided between peripheral portions of the rear plate and the face plate and constituting a vacuum container together with the rear plate and the face plate, and a spacer positioned in contact with the rear plate and the face plate and set at a potential defined by a current field, wherein a spacer heat resistance division ratio $\Psi_0$ represented by a following general equation (2) and a spacer electric resistance division ratio E satisfy a relation $0<\Psi_0<E<1$:

$$\Psi_0=Rh_{sp}/(Rh_{cfp}+Rh_{sp}+Rh_{crp}) \quad (2)$$

wherein:

$Rh_{cfp}$: heat resistance between spacer and face plate [$m^2$ K/W];

$Rh_{sp}$: heat resistance of spacer [$m^2$ K/W]; and $Rh_{crp}$: heat resistance between spacer and rear plate [$m^2$K/W];

$$E=Re_{sp}/(Re_{cfp}+Re_{sp}+Re_{crp}) \quad (4)$$

wherein:

$Re_{cfp}$: electrical resistance between spacer and face plate [Ω];

$Re_{sp}$: electrical resistance of spacer [Ω]; and $Re_{crp}$: electrical resistance between spacer and rear plate [Ω].

BRIEF DESCRIPTION OF THE DRAWINGS

FIGS. 6A, 6B1, 6B2 and 6C show heat resistance models of a spacer of the present invention;

FIGS. 7A, 7B1, 7B2, 7B3 and 7C show models of a heat resistance and an electrical resistance in case the electrical resistance and the heat resistance in a contact portion are substantially zero;

FIGS. 8A, 8B1, 8B2, 8B3 and 8C show models of a heat resistance and an electrical resistance in case a contact portion has a heat resistance while an electrical resistance is substantially zero;

DETAILED DESCRIPTION OF THE PREFERRED EMBODIMENTS

Figure 14:
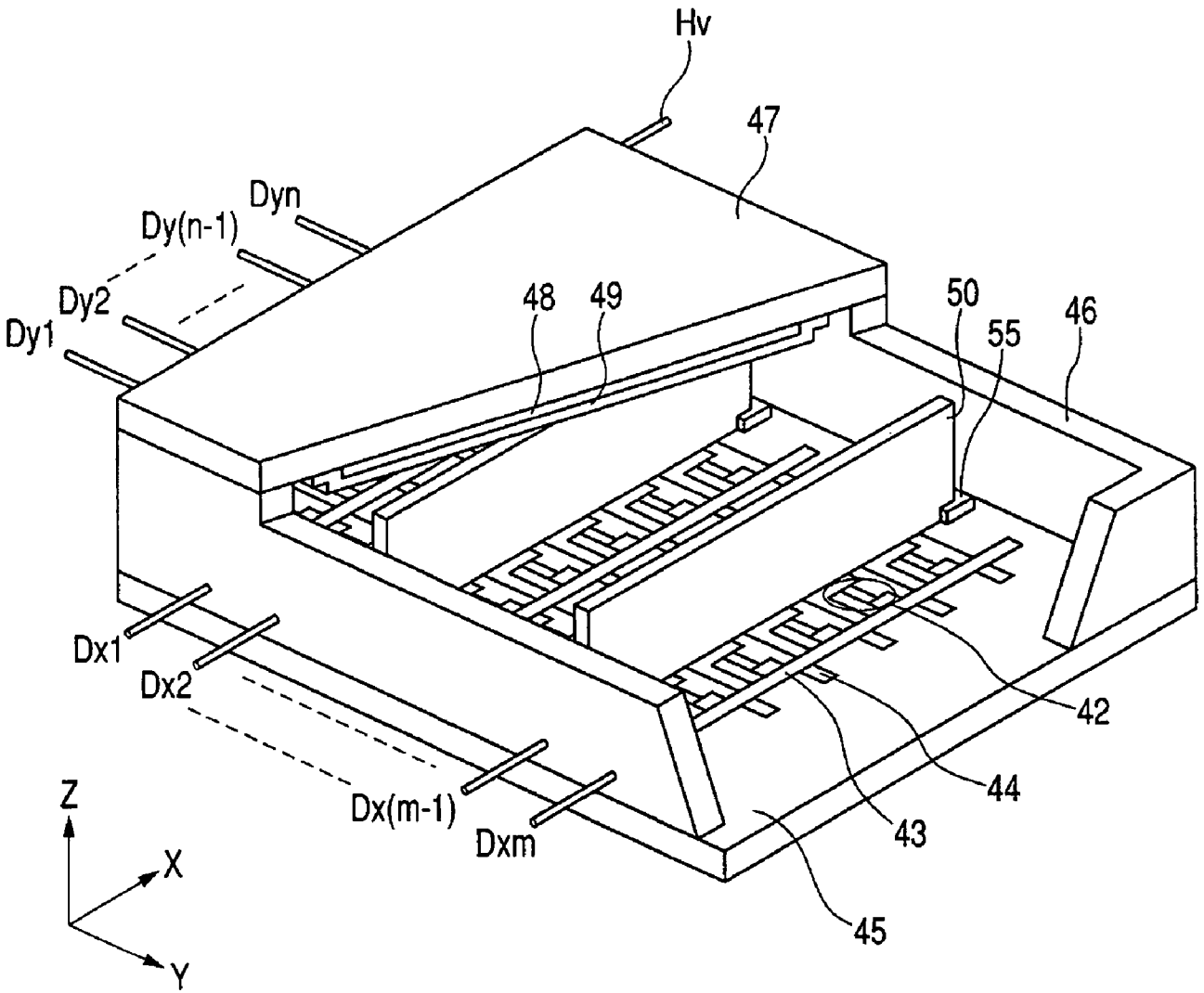
FIG. 14 is a schematic perspective view showing a display panel of an image forming apparatus of the present invention.

FIG. 14 schematically shows a configuration of a display panel, constituting an embodiment of the image forming apparatus of the present invention. In FIG. 14, a part of the panel is removed in order to show an internal structure. In FIG. 14, there are shown an electron emitting device 42, a row wiring 43, a column wiring 44, a rear plate (electron source substrate or cathode substrate) 45, a frame member 46, a face plate (anode substrate) 47, a phosphor film 48, a metal back (anode electrode) 49, a spacer 50, and a fixing member 55 for the spacer.

In the present invention, the rear plate 45 constituting an electron source substrate and the face plate 47 constituting an anode substrate are seal bonded at peripheral portions thereof across the frame member 46, thereby constituting a vacuum container. The vacuum container, of which the interior is maintained at a vacuum of about $10^{-4}$ Pa, is provided therein with a spacer 50 of a rectangular plate shape as an atmospheric pressure resistant member in order to prevent a damage by the atmospheric pressure or by an unexpected impact. The spacer 50 is fixed at end portions thereof by a fixing member 55 in a position outside an image display area.

The rear plate 45 is provided with electron emitting devices 42 of surface conduction type by N×M units, which are arranged in a simple matrix by M row wirings 43 and N column wirings 44 (M and N being positive integers). Crossing portions of the row wirings 43 and the column wirings 44 are insulated by an unillustrated interlayer insulation layer. The present embodiment shows a configuration in which the surface conduction electron emitting devices are arranged in a simple matrix, but the present invention is not limited to such configuration and is advantageously applicable also to electron emitting devices of field emission (FE) type or MIM type, and is also not restricted to the simple matrix arrangement.

In the configuration shown in FIG. 14, the face plate 47 is provided with a phosphor film 48, and a metal back 49 which is already known as an anode electrode in the field of a cathode ray tube. The phosphor film 48 is for example divided into phosphors of three primary colors of red (R), green (G) and blue (B), and a black conductor (black stripe) is provided between the phosphors of respective colors. However the arrangement of the phosphors is not limited to a striped arrangement, but can also be other arrangements such as a delta arrangement, according to the arrangement of the electron emitting devices 42.

The spacer 50 employed in the present invention is arranged parallel to the row wiring 43 constituting the cathode electrode. It is electrically connected to the row wiring 43 and the metal back 49 constituting the anode electrode, and a potential thereof is statically defined by a current field. The spacer may be constituted of a substrate of a single composition, which is formed by an electrically conductive member and is defined in potential. It is preferably formed by covering a surface of an insulating substrate with a high resistance film of a resistance lower than that of the insulating substrate, and such high resistance film may be used as an element for defining the potential of the spacer.

The present inventors have analyzed a mechanism of generating a fluctuation in the incident position of the electron beam by a front-rear temperature difference of the display panel as follows, thereby identifying control factors. The front-rear temperature difference of the display panel means a temperature difference between the face plate and the rear plate. In the following description, FP indicates the face plate, RP the rear plate and SP the spacer.

[Step 1: FP/RP External Surface Temperature Difference $\Delta T_1$]

A temperature distribution is generated on the front and rear surfaces of the panel by external and internal perturbations.

[Step 2: Temperature Difference $\Delta T_2$ in the Direction of Height of Spacer]

The spacer is in contact with FP and RP for supporting these plates. As a result, a heat conduction takes plate between FP and RP through the spacer as a heat conduction path, and a heat distribution is formed between a heat source of high temperature side and a heat source of low temperature side.

[Step 3: Electrical Resistance Distribution $\Delta R$ in the Direction of Height of Spacer]

An electrical resistance generally has a temperature dependence. Particularly a dielectric material and a high resistance material, employed in the spacer for realizing a high dielectric strength thereof, have a higher temperature dependence of resistance, in comparison with a low resistance material. Consequently a spacer having a temperature distribution generates a distribution in the electrical resistance.

[Step 4: Fluctuation $\Delta V_1$ of Surface Potential of Spacer]

When the potential of the spacer is defined by a current field, an electrical resistance distribution of the spacer surface generates an electric field distribution, whereby a potential in each area in the direction of height of the spacer is subjected to a fluctuation.

[Step 5: Potential Distribution Fluctuation $\Delta V_2$ in Space in the Vicinity of the Spacer]

In the vicinity of the spacer, because of a difference in the dielectric constant between the spacer and the vacuum, lines of electric force are deflected at the spacer surface as an interface. As a result, though the potential is continuous in the vicinity of the interface, the potential gradient becomes discontinuous, thereby locally deforming the potential distribution.

[Step 6: Fluctuation $\Delta x$ in Incident Position of Electron Beam in the Vicinity of Spacer]

An electron beam emitted from an electron emitting device is accelerated and reaches the anode electrode, and, in case of a deformation in the electric field distribution in the vicinity of the spacer, the trajectory of the electron beam is also affected, whereby the incident position is displaced by a displacement $\Delta x$ from a desired position.

The above-mentioned steps take place substantially simultaneously in the visual characteristics of human being. It is therefore difficult to suppress the fluctuation in the incident position of the electron beam by a delay in time, and it becomes necessary to control at least one of absolute values of fluctuation factors in each step.

For quantitative understanding of the aforementioned relationships, the fluctuation factors can be broken down as follows.

(Steps 1, 2: Basic Equation for Stationary Heat Conduction)

A relation of $\Delta T_1$ and $\Delta T_2$ will be formulated and explained with reference to FIGS. 1 to 3, in which shown are a face plate (FP) 1, a rear plate (RP) 2, and a spacer (SP) 3.

At first there is identified a factor determining the temperature difference $\Delta T_2$ in the direction of height of the spacer.

As the spacer applied to the image forming apparatus of the present invention functions in vacuum, a convectional heat exchange need not be considered. Also an irreversible heat conducting mechanism by ionic diffusion between the members need not be considered. Therefore, a comparison was made on a dependence of a total radiation heat exchange amount between the surface exposed to the vacuum of each of FP and RP and the spacer surface, on the front-rear temperature difference $\Delta T_1$. Also a comparison was made on a total heat conduction amount from a contact portion of FP with the spacer to a contact portion of RP with the spacer, on the front-rear temperature difference $\Delta T_1$. FIG. 1 shows an evaluation model, and FIG. 2 shows a result of investigation.

Figure 1:
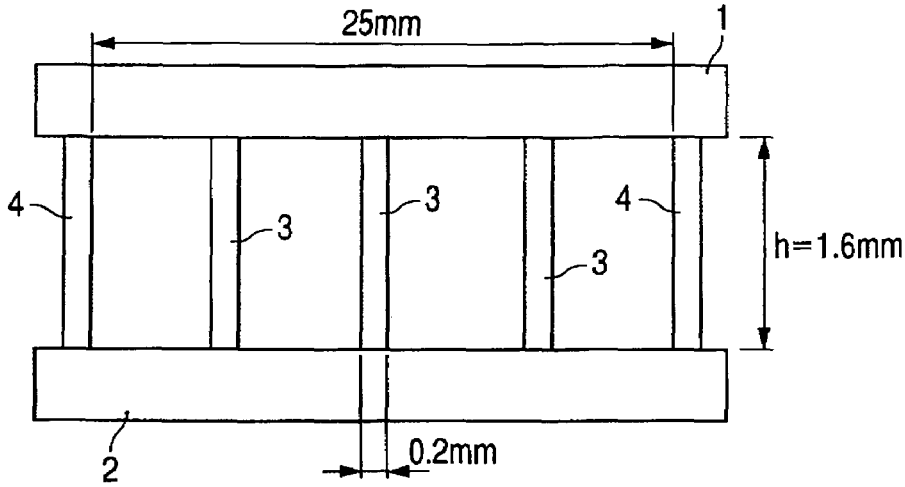
FIG. 1 is a schematic view of an evaluation model for evaluating a dependence of a total heat conduction amount in the direction of height of a spacer, on a front-rear temperature difference $\Delta T_1$ of the panel.

The evaluation model shown in FIG. 1 was calculated according to following principles:

Heat radiation follows Planck's law and Stefan-Boltzmann's law, $q=\sigma\Psi 4$ [W/m$^2$];

Each member is a gray member, following Kirchhof's law. Also a heat radiation rate ρ and an absorbance ρ satisfy a relation: a reflectance=1−ρ;

A radiation energy exchange depends on a shape factor $F_{ij}$ determined by mutual geometrical relationship (indicating a series portion in a right-hand second term of the following radiation heat amount qi. Namely a heat absorption of a face i from other surfaces is represented by a sum (integration) of a product: radiation of another surface j×shape factor $F_{ij}$ between the surfaces i and j×absorbance of the surface i); and An equilibrium stands for heat radiation: div q=0.

Comparison is made on following two evaluation parameters:

heat conduction transport amount: $q\ [W]=K\times A\times(T_{fp}-T_{rp})$ radiation heat amount−absorption heat amount: $q_1[W]=\sigma T4-\rho i\Sigma F_{ij}q_jK$: thermal conductivity of effective spacer portion [W/m$^2$K], wherein:

A: cross section [m$^2$] of spacer in a direction parallel to FP and RP $T_{fp}$: absolute temperature [K] of FP $T_{rp}$: absolute temperature [K] of RP $F_{ij}$: shape factor from area j to area I qi: radiation energy amount [W] of area i.

Figure 2:
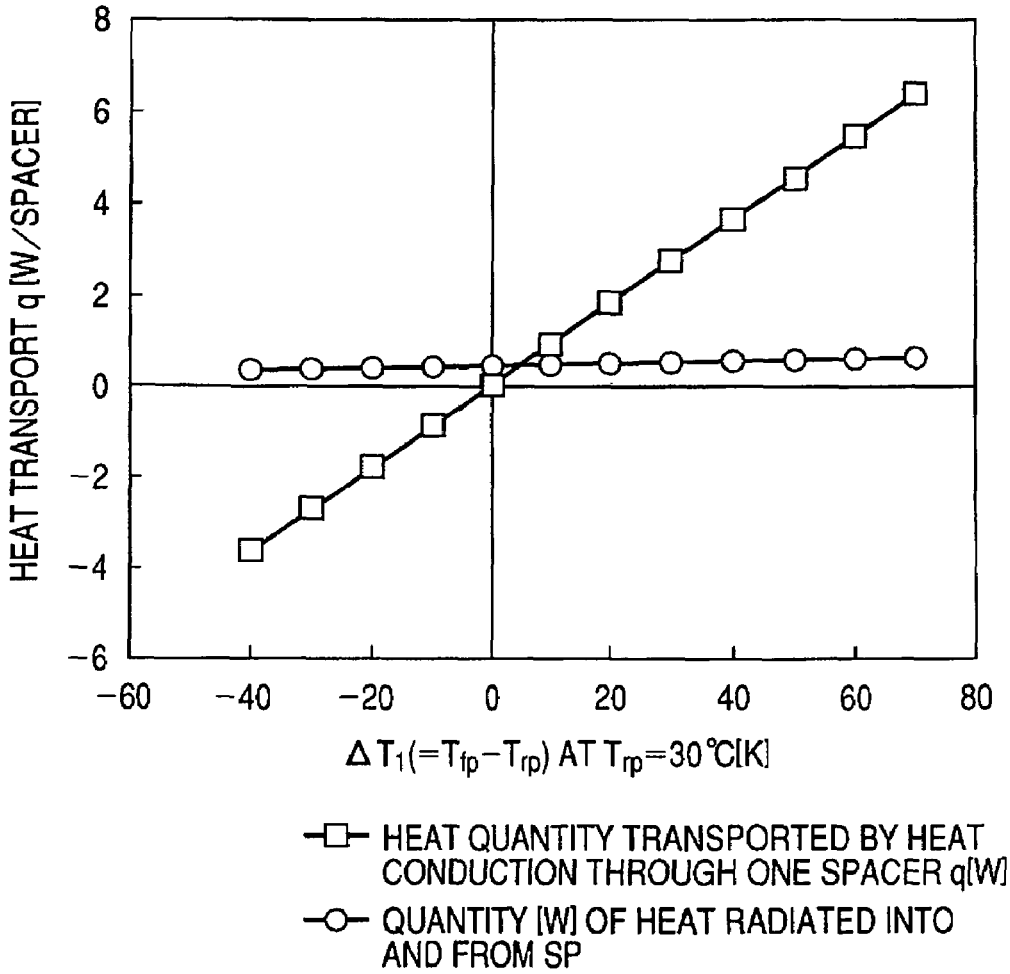
FIG. 2 is a chart showing a result of evaluation in the evaluation model shown in FIG. 1.

FIG. 2 indicates that the heat conduction is governing in the heat transfer amount between the spacer and a member other than the spacer, generated by the front-rear temperature difference $\Delta T_1$ of the panel. It is also identified that the temperature difference $\Delta T_2$ in the direction of height in the panel is determined by such heat conduction. This results from following facts:

The surfaces of FP and RP exposed to the vacuum are covered with a metallic material of a low radiation:

The spacer material has a relatively high radiation rate, but the spacer has an extremely small height, with respect to the area of FP or RP exposed to the vacuum and constituting a counterpart of heat exchange at the heat radiation by the spacer; and A view angle from the spacer is small, namely a shape factor $F_{ij}$ determined by the geometrical relationship between the members i and j is sufficiently small.

Figure 3:
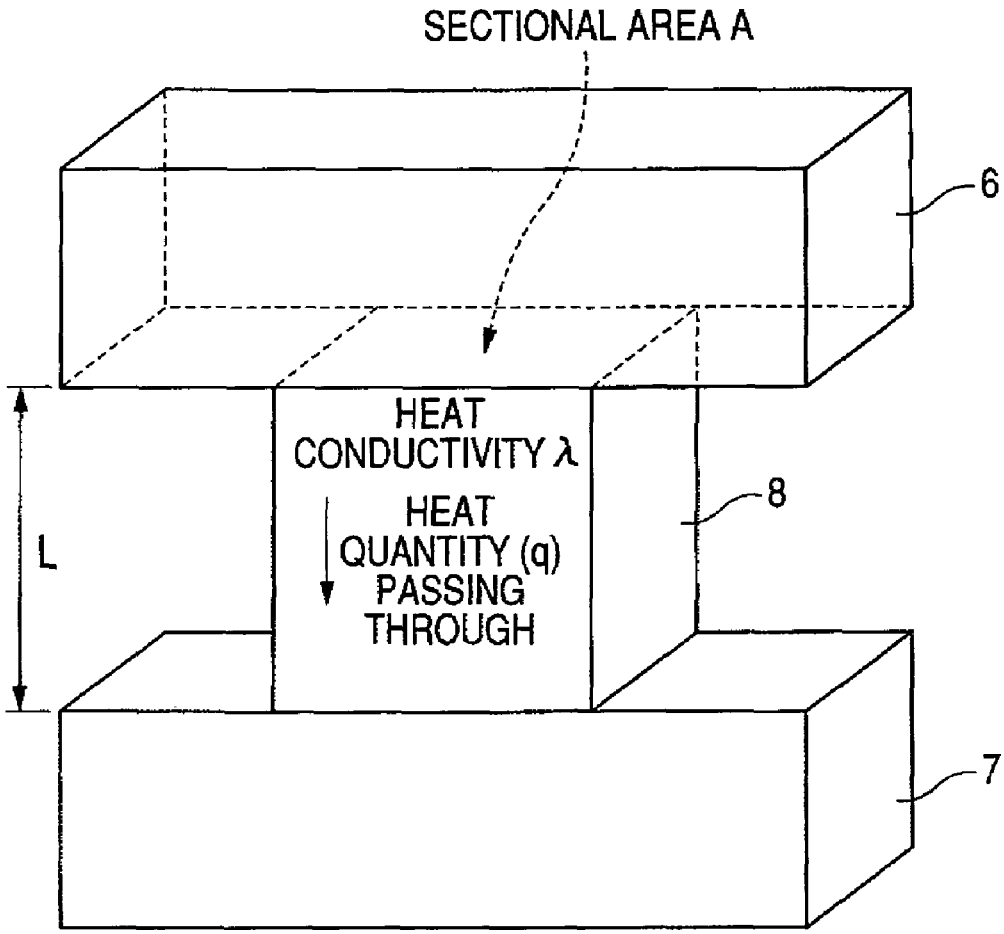
FIG. 3 is a view of a heat conduction model for quantitatively determining a temperature distribution of a spacer of the present invention.

A heat conduction between three members through contact portions thereof can be described uniquely by a heat conduction model shown in FIG. 3 and following general equations (5) and (6). It is then formulated according to the heat conduction model shown in FIG. 3, in order to quantify the temperature distribution of the spacer portion.

A heat conduction between three members through contact portions thereof can be described uniquely by a heat conduction model shown in FIG. 3 and following general equations (5) and (6). This is described in JSME "Heat Transfer Handbook" 4th edition, page 5, Chap. 1, Item 1, Basic equation for stationary heat conduction for simple flat plate. In FIGS. 3, 6, 7 and 8 indicate various members.

$$\text{heat conduction amount: } q\ [W]=KA(T_1-T_2) \tag{5}$$

$$\text{thermal conductivity: } K\ [W/m^2K]=1/\{(1/h_1)+(L/\lambda)+(1/h_2)\} \tag{6}$$

wherein:

$T_1$: temperature of upper member 6 [K]

$T_2$: temperature of lower member 7 [K]

K: thermal conductivity [W/m$^2$K]

A: cross section [m$^2$] of intermediate member 8

L: length [m] of heat conduction path (height of intermediate member 8)

$h_1$: thermal conductivity [W/m$^2$K] at a contact portion (contact portion 1) between the upper member 6 and the intermediate member 8

$h_2$: thermal conductivity [W/m$^2$K] at a contact portion (contact portion 2) between the lower member 7 and the intermediate member 8

λ: thermal conductivity [W/m$^2$K] of the intermediate member 8.

Also by assuming:

$\Delta T_1=T_1-T_2$: temperature difference [K] between the upper member 6 and the lower member 7, and $\Delta T_2$: temperature difference [K] in the direction of height of the intermediate member 8, and applying a law of heat flow continuity, the general formula (5) provides:

$$q\ [W]=KA\times\Delta T_1=(\lambda/L)A\times\Delta T_2,$$

therefore:

$$\Delta T_2=(L/\in K)\times\Delta T_1.$$

By substituting the upper member 6 with FP, the lower member 7 with RP and the intermediate member 8 with a spacer, $\Delta T_2$ is uniquely defined by $\Delta T_1$ as indicated in a following general formula (7):

$$\Delta T_2=\frac{h}{\lambda\left(\frac{1}{t_f}+\frac{h}{\lambda}+\frac{1}{t_r}\right)}\times\Delta T_1 \tag{7}$$

wherein:

$\Delta T_1$: FP/RP external surface temperature difference $\Delta T_2$: temperature difference in the direction of height of spacer L: height [m] of spacer $h_1$: thermal conductivity [W/m$^2$K] at a contact portion between FP and spacer $h_2$: thermal conductivity [W/m$^2$K] at a contact portion between RP and spacer λ: thermal conductivity [W/m$^2$K] of spacer.

Also a coefficient of $\Delta T_1$ corresponds to a heat resistance division ratio in the entire heat conduction path of the spacer. Therefore, it is uniquely determined by a following general formula (8), taking a spacer heat resistance division ratio $\Psi_0$. Also $\Psi_0$ is represented by a following general formula (2) formed by a combination of heat resistances Rh (reciprocal of thermal conductivity):

$$\Delta T_2=\Psi_0\times\Delta T_1 \tag{8}$$

$$\Psi_0=Rh_{sp}/(Rh_{cfp}+Rh_{sp}+Rh_{crp}) \tag{2}$$

wherein:

$Rh_{cfp}$: heat resistance between spacer and face plate [$m^2K/W$];

$Rh_{sp}$: heat resistance of spacer [$m^2K/W$];

$Rh_{crp}$: heat resistance between spacer and rear plate [$m^2K/W$].

(Step 3: Temperature Dependence of Resistance of High Resistance Material)

In the following, definition of the electrical resistance distribution ΔR in the direction of height of the spacer will be explained.

The spacer to be employed in the present invention has a potential defining element of a high resistance. Except for a case of obtaining a high resistance in the potential defining element by forming an electrical conductor such as a pure metallic material into a discontinuous thin film state, a high resistance material other than a metal generally has a negative strong temperature dependence.

A ceramic or amorphous (glass) material usually employed as a high resistance material on the spacer is constituted of an inorganic oxide or an inorganic nitride, and has an electron conductivity or a hole conductivity. Such material often has a temperature dependent resistance R(T) of activation type, as represented by a following general formula (9):

$$\frac{1}{R(T)} = \frac{1}{R\infty}\exp\left(-\frac{eEa}{kT}\right) \tag{9}$$

wherein:

Ea: activation energy [eV]

e: unit charge [C]

k: Boltzmann constant [J/K]

T: absolute temperature [T]

R: electrical resistance [Ω] at an imaginary infinite temperature.

Such high resistance material follows another conduction mechanism in an extremely low temperature range or in a high temperature range involving a structural change. However, it usually follows the formula (9) extremely satisfactorily in a temperature range of about 50° C. around the room temperature, wherein an ordinary display is used. In the present invention, therefore, the spacer is assumed to follow the temperature dependence of resistance represented by the general formula (9).

A resistance change rate ΔR/R(T) can be determined from the general formula (9) as follows:

$$R(T) = R\infty\exp\left(+\frac{eEa}{kT}\right)$$

$$\Delta R = \frac{\Delta R}{\Delta T}\times\Delta T \cong \frac{e(R(T))}{dT}\times\Delta T = -\frac{eEa}{kT^2}\times R\infty\exp\left(+\frac{eEa}{kT}\right)\times\Delta T$$

$$\frac{\Delta R}{R(T)} = -\frac{eEa}{kT^2}\times\Delta T$$

Therefore, a resistance change rate ΔR/R(T) in the direction of height of the spacer with a given temperature difference $\Delta T_2$ in the direction of height of the spacer is uniquely represented by a following general formula (10):

(Step 4)

$$\frac{\Delta R}{R(T)} = -\frac{eEa}{kT^2}\times\Delta T \tag{10}$$

Figure 4A:
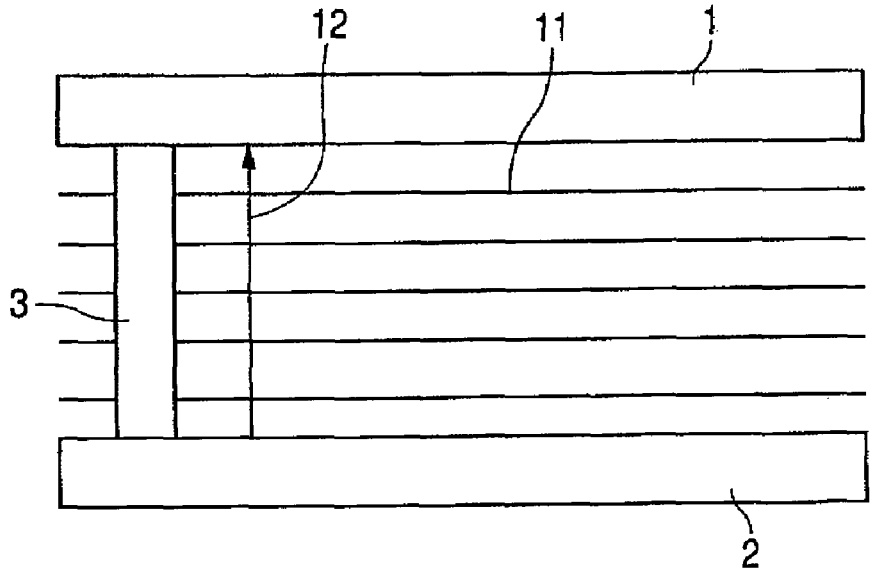
FIGS. 4A and 4B show an image model for calculating an electric field in a panel of the present invention.
Figure 4B:
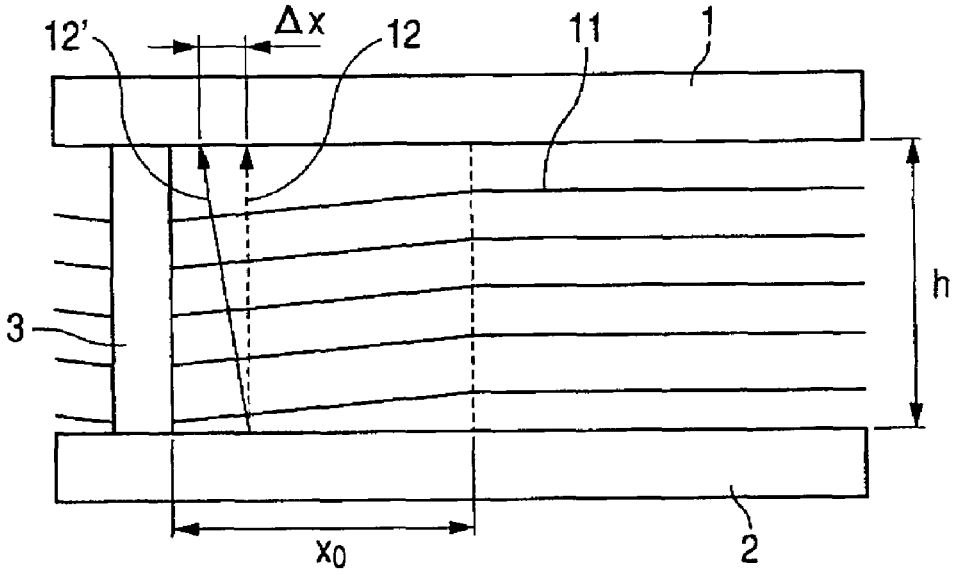
Figure 5:
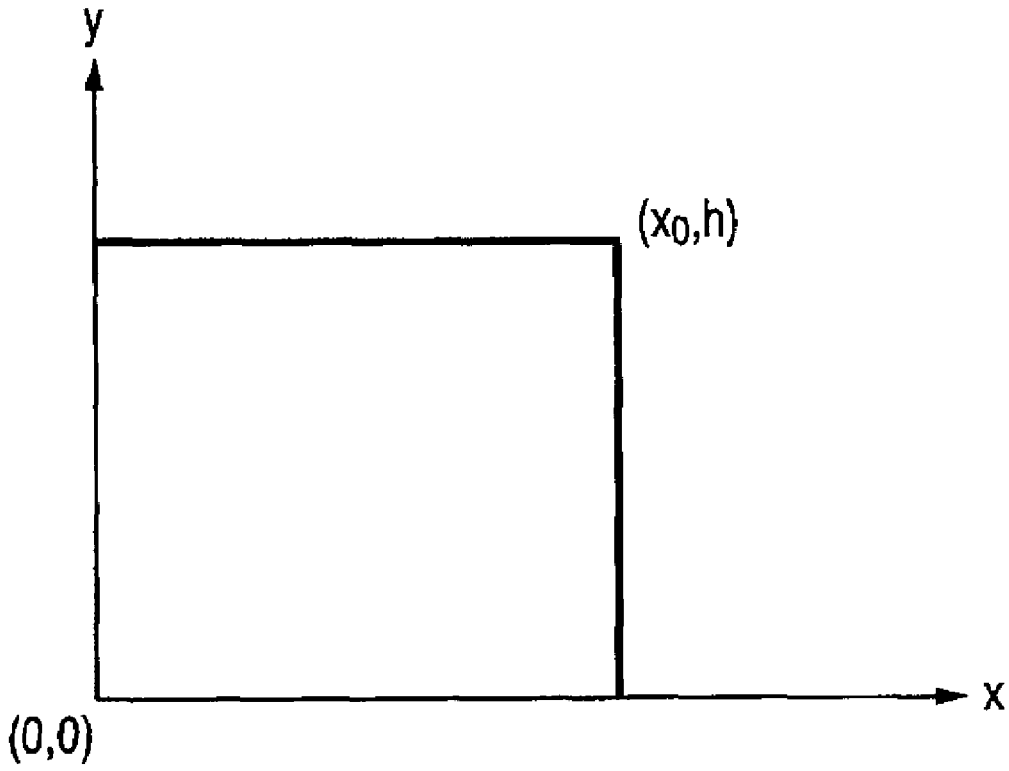
FIG. 5 shows a coordinate model obtained by simplifying the model shown in FIGS. 4A and 4B.

A dependence of the surface potential of the spacer on the resistance change rate will be explained with reference to FIG. 4A to FIG. 5. FIGS. 4A and 4B show an model for calculating an electric field in a panel, showing a potential distribution where FP 1 is at a higher temperature than in RP 2. In the drawings, there are shown an equipotential surface 11, and electron beam trajectories 12, 12'. The electric field distribution has following features.

Even in case a potential in the vicinity of the spacer 3 is lowered, the potential distribution within the panel is not spatially influenced by the spacer 3 as the distance from the spacer 3 increases. Then, finally at a certain distance $x_0$, the potential follows a parallel and uniform potential distribution defined by a potential gradient between the anode (metal back 49 in FIG. 1) and the cathode (row wiring 43 in FIG. 14). In practice, such influence changes continuously according to the distance from the spacer 3, and the equipotential surface 11 also changes in continuous manner.

The model shown in FIG. 4 is a linear extrapolation of a trajectory of an object electron emitting device and an electric field gradient in the vicinity of such trajectory. In FIG. 4A, 12 indicates an original electron beam trajectory, while in FIG. 4B, 12' indicates an actual trajectory under the influence of the inclined electric field. A point $x_0$ not influenced by the spacer 3 is determined as an average point where the equilibrated uniform electric field and the inclined electric field. Typically, this point is determined as an average crossing point with an equilibrated uniform electric field in an area separated by about twice of the height h of the spacer 3. FIG. 5 shows a coordinate model further simplified from the model shown in FIG. 4.

The potential on the spacer 3, being defined by a current field, is subjected to a resistance division. As the resistance ratio at the end portion of the spacer is known, the potential on the spacer 3 is represented by a following general formula (11):

$$\frac{\partial V(O, y)}{\partial y} = Ey(O, y) = j\rho \propto \rho \propto R \tag{11}$$

For an electric field strength of Ey(x, y), boundary conditions of the electric field at both ends in the direction of height of the spacer provide:

$$\frac{Ey(O, h)}{Ey(O, O)} = \frac{R(h)}{R(O)} = \frac{R+\Delta R}{R} = 1 + \frac{\Delta R}{R}$$

Also the electric field distribution (function of resistance, temperature) on the spacer 3 can be assumed as linear in the direction of height, namely Ey(0, y)=Ey(0, 0)+ay.

As the boundary conditions of the electric field satisfy the general formula (11), there is obtained:

$$a = +\frac{Ey(O, O)}{h}\frac{\Delta R}{R}$$

$$\therefore Ey(O, y) = Ey(O, O)\left(1 + \frac{\Delta R}{R}\frac{y}{h}\right)$$

Further, based on the boundary conditions of the surface potential at the upper and lower ends of the spacer, a following relationship stands:

$$Va = \int_o^h Ey(O, y)\,dy$$

$$\therefore Ey(O, O) = \frac{Va}{h}\frac{1}{1 + \frac{\Delta R}{2R}}$$

An electric field strength, on the surface of the spacer 3 in the y-direction, at an end at the side of the cathode (RP 2) can be described by a following general formula (12):

$$Ey(O, y) = \frac{Va}{h}\frac{1 + \frac{\Delta R}{R}\frac{y}{h}}{1 + \frac{\Delta R}{2R}} \tag{12}$$

Therefore, the potential distribution in the direction of height of the spacer 3 can be described, with the resistance change rate ΔR/R, by a following general formula (13):

(Steps 5, 6)

$$V(0, y) = \int_0^y Ey(0, y)\,dy = \frac{Va}{h}\left(\frac{1}{1 + \frac{1}{2}\frac{\Delta R}{R}}y + \frac{\frac{1}{2}\frac{\Delta R}{R}}{1 + \frac{1}{2}\frac{\Delta R}{R}}\frac{y^2}{h}\right) \tag{13}$$

A potential fluctuation $\Delta V_2$ in the vicinity of the spacer 3 and a displacement Δx in the incident position of the electron beam in the vicinity of the spacer will be explained with reference to FIGS. 4A to 5.

FIG. 4A shows an ideal state where the panel has no front-rear temperature difference, and the potential distribution is not deformed in the space in the vicinity of the spacer 3. Also FIG. 4B shows a state where the panel has a front-rear temperature difference, and the potential distribution is deformed by the spacer 3 in a space close thereto whereby the beam trajectory changes from 12 to 12' and the incident position of the electron beam is displaced by Δx.

Conditions for calculation are as follows:

displacement of incident position of electron beam on the anode: Δx [m]

anode-cathode voltage: Va [V]

spacer height: h [m]

range of influence of potential distribution on the spacer surface: $0<x<x_0$ [m]

electron mass: m [kg]

In the following, there will be shown a level of potential deformation by the spacer 3 in a space close thereto. α is a coefficient of influence of the electric field of spacer, and is a no-dimensional parameter defined by normalizing the height h of the spacer with the range $x_0$ of the influence of the spacer electric field.

spacer electric field influence coefficient: $\gamma h=\gamma x_0$.

Under these conditions, the boundary conditions of potential in peripheral area are represented as follows in the coordinate model shown in FIG. 5:

$$V(0, y) = \frac{Va}{h}\left(\frac{1}{1 + \frac{1}{2}\frac{\Delta R}{R}}y + \frac{\frac{1}{2}\frac{\Delta R}{R}}{1 + \frac{1}{2}\frac{\Delta R}{R}}\frac{y^2}{h}\right)$$

$$V(x0, y) = (Va/h) \times y$$

$$V(x, 0) = 0$$

$$V(x, h) = Va$$

The electric field under such boundary conditions is linearly interpolated to obtain an electron trajectory in such electric field distribution. The electron beam trajectory from an electron emitting device in the vicinity of the spacer 3 follows a following equation of motion based on an electron position [x, y], a time t and an electron mass m:

$$m\begin{pmatrix}\ddot{x}\\ \ddot{y}\end{pmatrix} = e\begin{pmatrix}E_x\\ E_y\end{pmatrix} = e\begin{pmatrix}\frac{V_{(0,y)} - V_{(x_0,y)}}{x_0}\\ \frac{V_{(x,h)} - V_{(x,0)}}{h}\end{pmatrix}(t \geq 0)$$

$$(\dot{x}, \dot{y}) = (0, 0)\ (t = 0)$$

It provides a following algebraic solution:

$$\Delta x = \frac{1}{10}\frac{1 - \frac{1}{2}\frac{\Delta R}{R}}{1 + \frac{1}{2}\frac{\Delta R}{R}}\frac{h^2}{x_0}$$

It is then modified with the spacer electric field influence coefficient $h=\alpha x_0$ to provide a following general formula (14):

$$\Delta x = -\frac{\gamma}{10}\frac{\frac{1}{2}\frac{\Delta R}{R}}{1 + \frac{1}{2}\frac{\Delta R}{R}}h \tag{14}$$

Also in case the resistance change rate ΔR/R is not so large, it can be represented by a following general formula (15):

$$\Delta x = -\frac{\gamma}{20}\frac{\Delta R}{R}h\left(\Theta 1 \gg \frac{1}{2}\frac{\Delta R}{R}\right) \tag{15}$$

By substituting the spacer electric field influence coefficient α with a parameter $\Psi_2$ given by a general formula (16):

$$\Psi_2=\alpha/20 \tag{16}$$

there is given a following general formula (17):

$$\Delta x = -\Psi_2 \times (\Delta R/R) \times h \tag{17}$$

wherein $\Psi_2$ is a dimension-free parameter, taken as a spacer sensitivity.

Thus the displacement Δx of the incident position of the electron beam in the vicinity of the spacer having a resistance change range ΔR/R is identified to be proportional to the spacer sensitivity $\Psi_2$ and the resistance change range ΔR/R.

Also the displacement Δx of the incident position of the electron beam in the vicinity of the spacer in the presence of a front-rear temperature difference ΔT of the panel can be given, utilizing the foregoing general formulas (8), (10) and (17), by a following general formula (18):

$$\Delta x = \Psi_0 \times \Psi_2 \left(\frac{eEa}{kT^2} h\right) \Delta T_1 \tag{18}$$

The general formula (18), represented in the unit of distance, can be normalized by a device pitch of the electron emitting devices, for the purpose of evaluation of display characteristics, as a following general formula (19):

$$\frac{\Delta x}{P_y} = \Psi_0 \times \Psi_2 \left(-TCR \frac{h}{Py}\right) \Delta T_1 = \Psi_0 \times \Psi_2 \left(\frac{eEa}{kT^2} \frac{h}{Py}\right) \Delta T_1 \tag{19}$$

A device pitch Py [m] is a pitch of the electron emitting devices in a direction perpendicular to the spacer surface, parallel to a normal line to FP and RP.

As a result of studies undertaken by the present inventor, it is found, as explained in the foregoing, that a following value should be controlled according to the general formula (19) in order to suppress the fluctuation Δx in the incident position of the electron beam in the vicinity of the spacer, resulting from the front-rear temperature difference of the panel:

$$\Psi_0 \times \Psi_2 \left(\frac{eEa}{kT^2} \frac{h}{Py}\right).$$

In the following there will be shown specific methods for suppressing the fluctuation in the incident position of the electron beam in the vicinity of the spacer, represented in the general formula (19):

(a) to reduce h/Py
(b) to reduce eEa/kT$^2$
(c) to reduce 1/kT$^2$
(d) to reduce $\Psi_0$, specifically to 0.5 or less (second invention)
(e) to reduce $\Psi_2$, specifically to 0.25 or less
(f) to reduce $\Psi_0 \times \Psi_2$, specifically to 0.05 or less (first invention).

These methods (a) to (e) may be combined to provide a further increased effect.

In the following, each method will be explained in detail.

(a) To Reduce h/Py

It means, for a given pixel pitch Py [m] of the display, to suppress the height of the spacer. Py is uniquely determined by a size and a resolution (pixel number) of the display, and is usually about 0.3 to $0.6 \times 10^{-3}$ m. Under such condition, a lower limit of the generally selected h is determined by luminance characteristics, pressure resistant characteristics and vacuum characteristics, and the spacer height is selected at about 0.5 to $2 \times 10^{-3}$ m. Therefore h/Py assumes a value of about 2 to 5, preferably 2.5 or less.

(b) To Reduce eEa

This method is to reduce an activation energy Ea [eV] of resistance, which is one of the potential defining factors of the spacer. In the material selection, a metallic material or a material of a smaller band gap, namely a material with a low volumic resistivity at the room temperature, tends to show a low Ea. The volumic resistivity at the room temperature can be represented as Rs×t, utilizing a sheet resistance Rs and a thickness t at the room temperature. These are to be selected within following ranges for a lower limit.

A lower limit of the sheet resistance Rs is principally defined by the electric power consumption of the spacer. A lower limit of the sheet resistance in consideration of the electric power consumption is usually about $1 \times 10^{10}$ Ω/sq for an anode voltage (Va) of 10 kV.

A lower limit of the thickness t is defined by a strength in case the spacer is constituted of a single substrate, and is about 50 μm. On the other hand, in case the spacer is formed by coating the surface of an insulating substrate with a high resistance film of a lower resistance, and such high resistance film constitutes the potential defining element, a lower limit of the thickness of the high resistance film is defined in consideration of an electron penetration length and a uniformity of resistance, and is preferably about 100 nm. In consideration of the foregoing, there is preferred a configuration of coating the surface of an insulating substrate with a high resistance film of a lower resistance, in order to satisfy the requirements for electric power consumption and heat generation. Such configuration allows to set the volumic resistivity at a low level and to select a material of a low band gap, thereby advantageously reducing the activation energy. More preferably, the activation energy of the resistance is 0.35 eV or less, further preferably 0.25 eV or less.

(c) To Reduce 1/kT$^2$

This corresponds to an increase in the operation temperature of the spacer. It is conceivable to reduce the sheet resistance of the spacer itself, thereby increasing Joule's heat, and to restrict the heat conduction to FP and RP. A specific method is similar to the suppression of $\Psi_0$ to be explained later.

(d) To Reduce $\Psi_0$ $\Psi_0$ is preferably 0.5 or less. Now methods of controlling the spacer heat resistance division ratio $\Psi_0$ will be explained with reference to FIGS. 6A to 6C, 7A to 7C and 8A to 8C, wherein 21 and 22 indicate contact portions of the spacer 3 with FP 1 and RP 2. In case $\Psi_0$ is larger than 0.5, the temperature difference in the spacer is close to that in the panel. In such case, the control of the beam position becomes unstable, and the local operation temperature of the spacer tends to show fluctuation. There also result an increase in a relaxation time constant in suppressing charging and an increase in the electric power consumption.

Figure 6A:
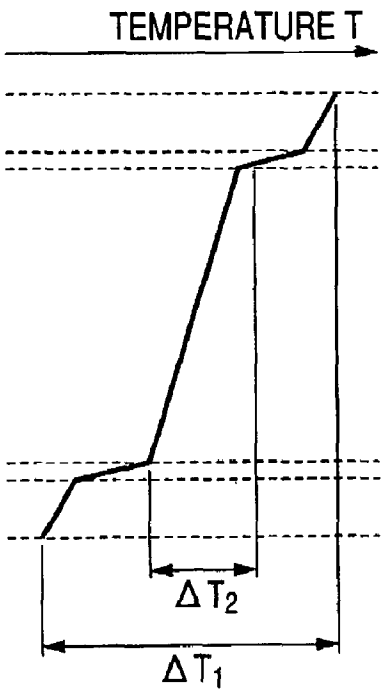
Figure 6A:
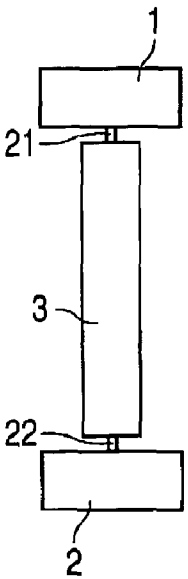
Figure 6A:
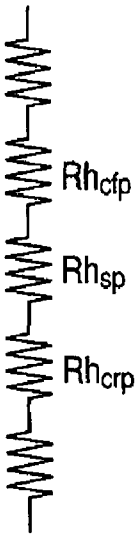
Figure 6C:
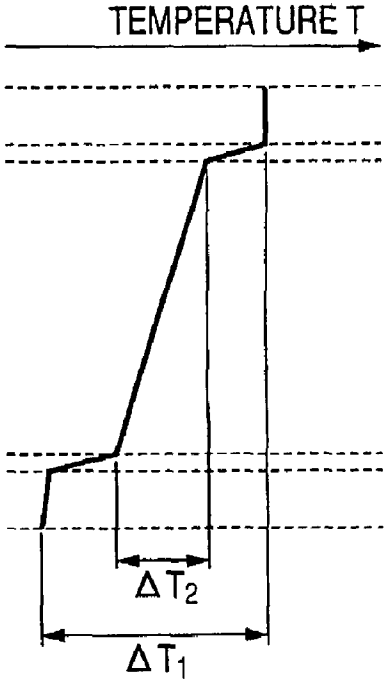

Heat resistance models of the spacer are shown in FIGS. 6A to 6C, in which FIG. 6B1 shows a model configuration, FIG. 6B2 shows a heat resistance, and FIGS. 6A and 6C show temperature gradient profiles respectively in case an external heat source or an internal heat source is governing.

As the heat sources generating the temperature difference in the direction of height of the spacer, heat resistances involving the spacer 3 and the contact portions 21, 22 are identified as governing. The heat sources are present inside and outside the panel, but both are added in most cases. The heat sources outside the panel include a driver circuit between the panel and the casing, a heat radiation, a heat convection and a heat conduction from the exterior of the casing. Also the heat sources inside the panel include a Joule's heat of the spacer, an electric power loss of the phosphor, and a Joule's heat of the cathode. Among these heat sources, the heat of the vacuum container and the casing, resulting from the external factors, can be made uniform by introducing a fan or a heat sink. The heat sources inside the panel are identified as governing as the heat source. In particular, the heat generation by the phosphor film by an electric power loss and by the cathode by an electric power loss are identified as governing. As the locations of heat generation are present on the vacuum sides of FP and RP, the heat resistances of FP and RP need to be little considered for the temperature difference in the spacer. Therefore, the heat resistance generating element required for controlling $\Psi_0$ is an element between the cathode and the anode.

Figure 7A:
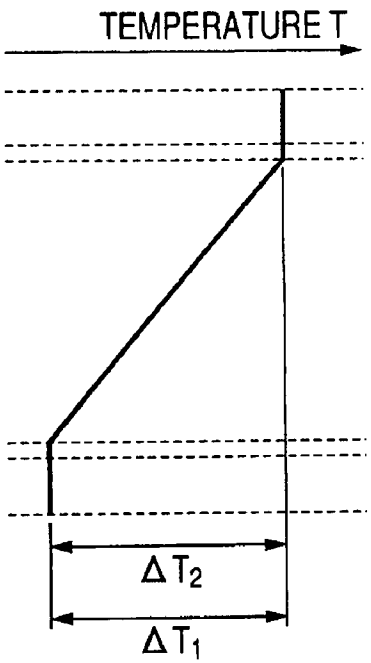
Figure 7A:
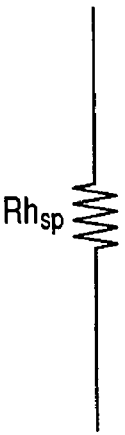
Figure 7A:
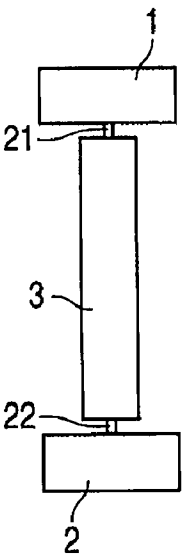
Figure 7A:
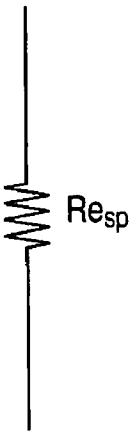
Figure 7C:
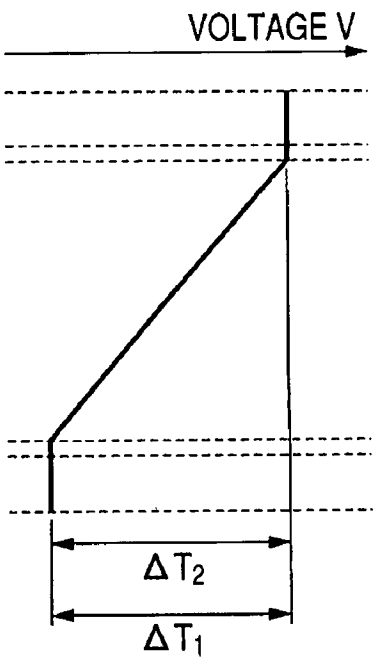

FIGS. 7A to 7C show a heat resistance model and an electric resistance model, in case a spacer 3, having metallic members for electrical contact in the contact portions 21, 22 or a spacer having a sufficient contact area in the contact portions, is positioned between the anode and the cathode. A spacer of such configuration is disclosed for example in U.S. Pat. Nos. 5,614,781 and 5,742,117.

FIG. 7A shows a temperature gradient profile; FIG. 7C shows a potential gradient profile; FIG. 7B1 shows a model configuration; FIG. 7B2 shows a heat resistance in case the contact portions 21, 22 have a substantially zero heat resistance; and FIG. 7B3 shows an electrical resistance in case the contact portions 21, 22 have a substantially zero electrical resistance.

As shown in these drawings, when the heat and electrical resistances are substantially zero in the contact portions 21, 22, the spacer becomes governing in the heat resistance between the anode and the cathode, whereby $\Psi_0$ becomes substantially 1. Also the electrical resistance division ratio E of the spacer, represented by the following general formula (4), becomes substantially 1, thereby facilitating the potential distribution in the spacer:

$$E=Re_{sp}/(Re_{cfp}+Re_{sp}+Re_{crp}) \tag{4}$$

wherein:

$Re_{cfp}$: electrical resistance between spacer and FP (contact portion 21) [Ω];

$Re_{sp}$: electrical resistance of spacer [Ω]; and $Re_{crp}$: electrical resistance between spacer and RP (contact portion 22) [Ω].

Figure 8A:
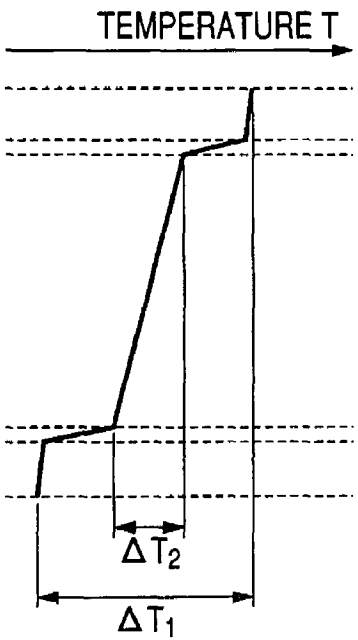
Figure 8A:
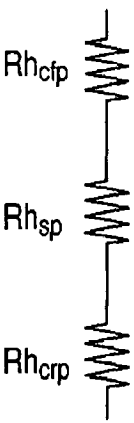
Figure 8A:
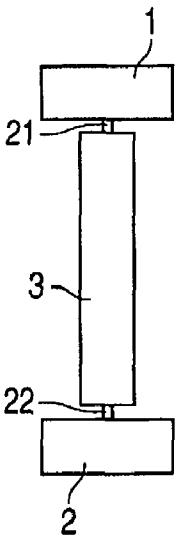
Figure 8A:
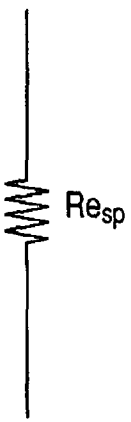
Figure 8C:
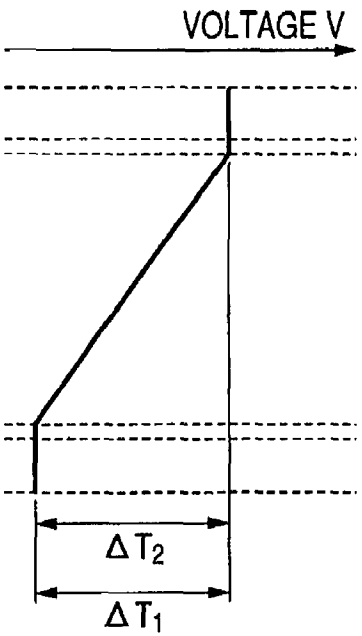

On the other hand, FIGS. 8A to 8C show a heat resistance model and an electric resistance model, in case the contact portions 21, 22 have heat resistances and substantially zero electrical resistances.

FIG. 8A shows a temperature gradient profile; FIG. 8C shows a potential gradient profile; FIG. 8B1 shows a model configuration; FIG. 8B2 shows a heat resistance; and FIG. 8B3 shows an electrical resistance.

A configuration shown in FIGS. 8A to 8C allows to define the potentials of the contact portions 21, 22 simultaneously while suppressing $\Psi_0$. More specifically, there can be provided contact portions 21, 22 which generate heat resistances but have negligibly small electrical resistances. Stated differently, the spacer electrical resistance division ratio E represented by the general formula (4) and the spacer heat resistance division ratio $\Psi_0$ represented by the general formula (2) need to satisfy a relation $0<\Psi_0<E<1$. An image forming apparatus satisfying such relation constitutes a third aspect of the present invention.

In case of constructing an image forming apparatus having contact portions 21, 22 having a low electrical resistance and a high heat resistance, a contact member is preferably provided in the contact portions 21, 22. In such case, there is preferably employed a thermoelectric converting material utilized for example in a Peltier element. Such thermoelectric converting material is required to have a low electrical resistance and a high heat resistance, and is therefore suitable as the contact member.

Also in the present invention, in order to increase the heat resistances of the contact portions 21, 22, it is preferable to suppress the area of the contact portions 21, 22. It is therefore preferable to provide contact members in the contact portions 21, 22 between the spacer 3 and the FP 1 and RP 2, and to suppress the cross section of such contact members. More specifically, for cross sections $S_{cr}$ and $S_{sp}$ of the contact member and the spacer 3 in a direction parallel to FP and RP, a contact rate ($S_{cr}/S_{sp}$) is preferably 0.05 or less.

In case the contact members are present in the contact portions 21, 22, the potentials formed by such contact members are preferably so selected as not to influence the desired potential distribution in the space close to the spacer 3. For this purpose, the contact member is required to have such a height as not to hinder a linear potential gradient distribution in the direction of height of the spacer 3, and this defines an upper limit of the height of the contact member. Also the heat conduction path requires a sufficient length in order to provide the contact member with a sufficient heat resistance, and this defines a lower limit of the height (thickness) of the contact member. More specifically, the contact member preferably has a height of 1% or less of that of the spacer 3, with a thickness of about 1 to 20 μm.

Figure 9A:
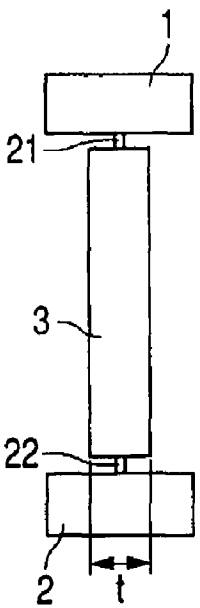
FIGS. 9A, 9B, 9C and 9D show a heat resistance model for explaining a specific contact member to be employed in the present invention.
Figure 9B:
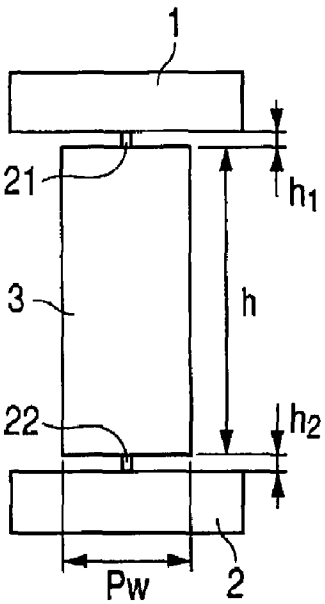
Figure 9C:
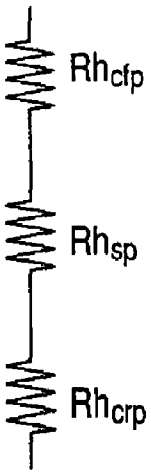
Figure 9D:
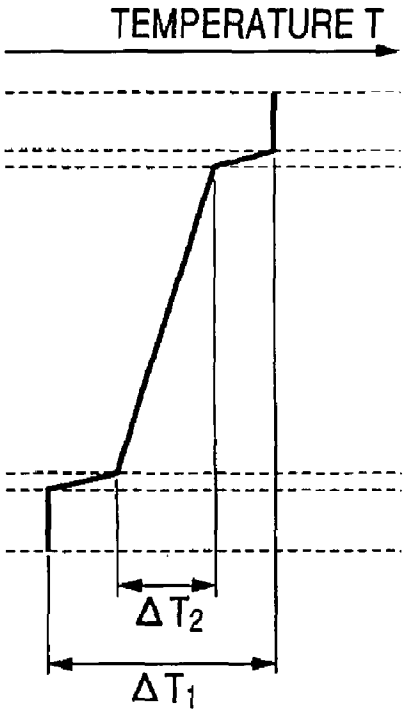

A size and a material constant of the contact member to be employed in the above-described conditions will be explained with reference to FIGS. 9A to 9D, wherein FIG. 9A shows a cross-sectional view of such model (seen from a direction of thickness (Y-direction in FIG. 14) of the spacer 3); FIG. 9B shows a lateral view (X-direction in FIG. 14); FIG. 9C shows a heat resistance; and FIG. 9D shows a temperature profile.

A relation required for the spacer heat resistance division ratio $\Psi_0$ is given by a following general formula (20), with a thermal conductivity $\in_c$ [W/mK] of contact members present at FP and RP sides, a thermal conductivity $\in$ [W/mK] of the spacer 3, heights $h_1$, $h_2$ [m] of the contact members, and a height h [m] of the spacer 3:

$$\frac{1}{(S_{cr}/S_{sp})}\times\frac{(h_1+h_2)}{\lambda_c}+\frac{h}{\lambda}\geqq\frac{1}{\Psi_0}\times\frac{h}{\lambda} \tag{20}$$

Also a condition that the potential drops of the contact members 21, 22 do not disturb the linear potential gradient on the lateral side of the spacer 3 can be described, utilizing the electrical resistance division ratio E of the spacer 3, as follows:

$$\frac{1}{(S_{cr}/S_{sp})t} \times \frac{(h_1+h_2)}{\sigma_c} + R_{sp}\frac{h}{2} \leqq \frac{1}{E}R_{sp}\frac{h}{2} \quad (21)$$

wherein t coincides with the thickness [m] of the spacer, $\sigma_c$ indicates an electrical conductivity [S/m] of the contact member; and $R_{sp}$ is a sheet resistance [Ω/sq] of the spacer.

Figure 10:
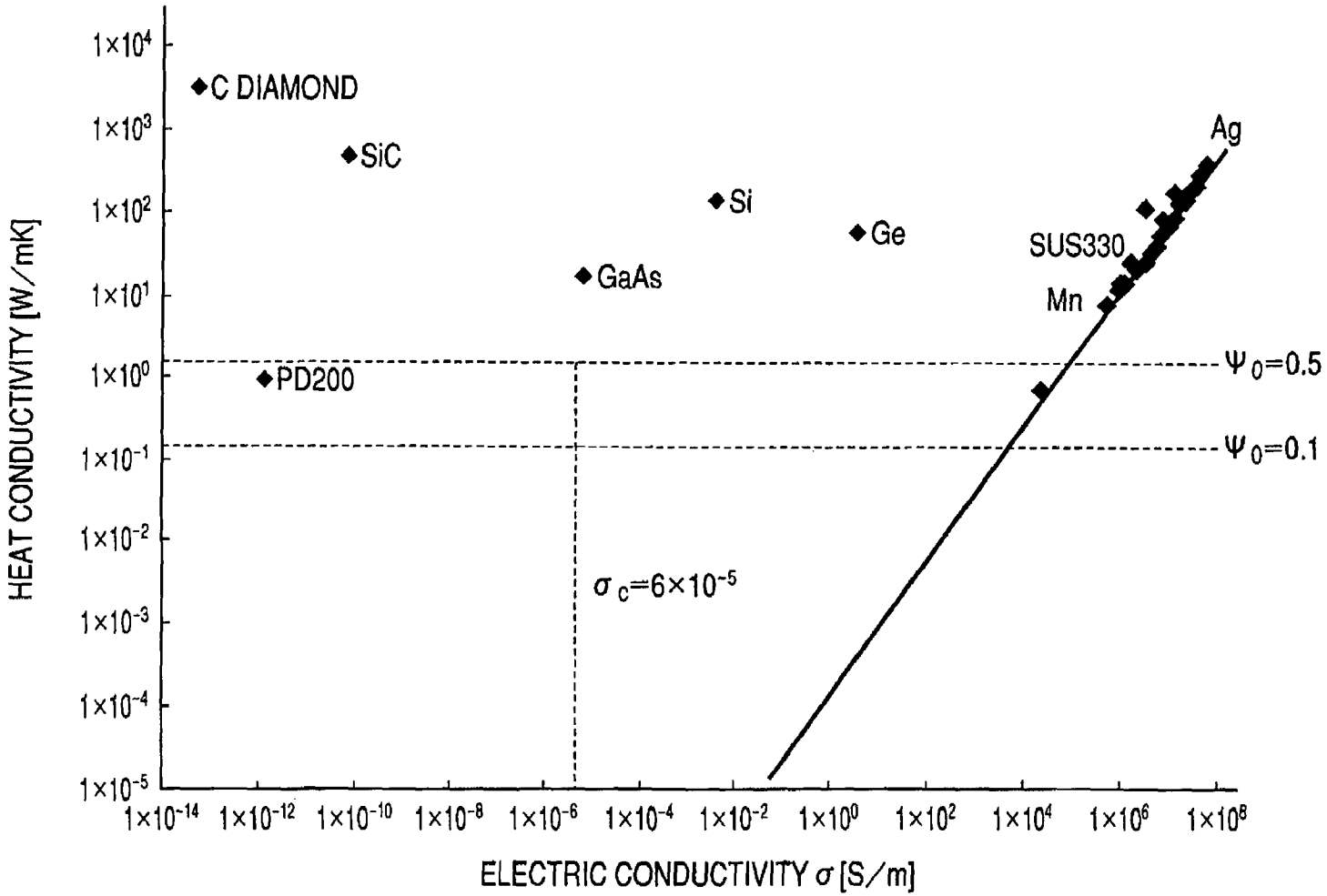
FIG. 10 is a σ-λ map showing a range of physical properties of a material for the contact member to be employed in the present invention.

As an example, imaginary design values are determined in case of employing an insulating glass material of a thermal conductivity $\in$=0.9 [W/mK] (for example PD200 manufactured by Asahi Glass Co.) as the spacer, with a contact rate ($S_{cr}/S_{sp}$) of 0.01, a height $h_1+h_2$ of the contact members of $20\times10^{-6}$ [m] and a spacer height $h=1.6\times10^{-3}$ [m]. In this case, the upper limit of the thermal conductivity of the contact member is 1.4 or 0.15 [W/mK] respectively for a spacer heat resistance division ratio $\Psi_0$ of 0.5 or 0.1. Also for realizing electrical conductivity in the contact portions, the electrical conductivity $\in_c$ of the contact member has a lower limit of $6\times10^{-5}$ [S/m]. FIG. 10 shows a σ-λ map showing a range of physical properties of the material realizing these conditions.

Figure 11:
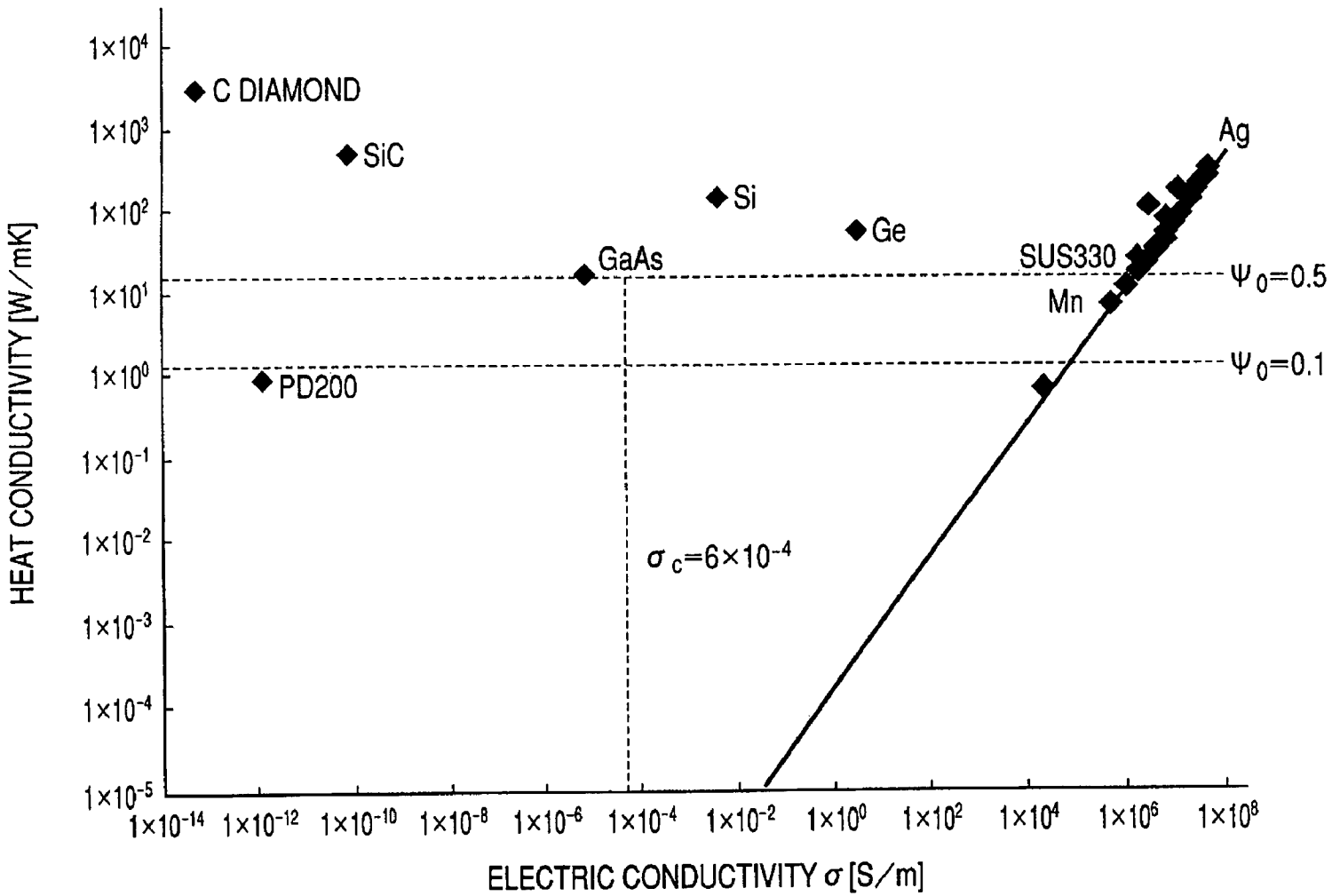
FIG. 11 is a σ-λ map showing a range of physical properties of a material for the contact member to be employed in the present invention.

Also imaginary design values are determined in a configuration same as above, except that the contact rate ($S_{cr}/S_{sp}$) is selected as 0.001. In this case, the upper limit of the thermal conductivity of the contact member is 14 or 1.5 [W/mK] respectively for a spacer heat resistance division ratio $\Psi_0$ of 0.5 or 0.1. Also for realizing electrical conductivity in the contact portions, the electrical conductivity $\in_c$ of the contact member has a lower limit of $6\times10^{-4}$ [S/m]. FIG. 11 shows σ-λ map showing a range of physical properties of the material realizing these conditions.

In FIGS. 10 and 11, materials belonging to a lower right area are effective as the contact member in the present invention. It can also be seen that metals are concentrated on a solid line, in an upper right portions thereof from a crossing point with a line of $\Psi_0$=0.5. Among these metals, Mn and stainless steel (SUS 330) have a relatively low thermal conductivity and a low electrical conductivity σ sufficient for defining the potential on the spacer. These metals can be sufficiently employable in the present invention, like the materials belonging to the preferred lower right area of σ-λ map.

In the present invention, as explained in the foregoing, a thermoelectric converting material employed in a Peltier device or a power generating apparatus is preferably employed in the contact member. Specific examples include a laminar cobalt oxide such as $Na_{1.2}Co_{2-x}Cu_xO_4$, $NaCl_2O_4$, and $Ca_{1.95}La_{0.05}Co_{2-x}Al_xO_5$. Such laminar cobalt oxides are called "oxide with strong electron-correlation effects" because of their specific electrical and thermal characteristics. Also a Te-containing alloy such as $AgPbBiTe_3$, $Bi_2Te_3$, PbTe or $Sb_2Te_3$, can also be employed advantageously. For such thermoelectric converting material, a Seebeck coefficient utilized in power generation may be employed as an index. In the present invention, a material having a Seebeck coefficient of 3 or more is preferred. Such thermoelectric converting material may be selected in consideration of the physical properties necessary for the thermoelectric converting efficiency, and more preferably in consideration of the heat resistance and the ease in the patterning. Also the method of securing the heat resistance in the contact portion is also effective for securing the operation temperature of the spacer in (c).

(e) To Reduce Spacer Sensitivity $\Psi_2$

In the present invention, the spacer sensitivity $\Psi_2$ is preferably a positive value of 0.25 or less, more preferably 0.15 or less. A spacer sensitivity $\Psi_2$ exceeding 0.25 increases a potential change in the space close to the spacer, thereby deteriorating the controllability of beam position. Also because of a distortion in the potential surface resulting from a height of a potential defining part of the spacer at the cathode side different from the cathode height, there results a drawback of an increase displacement of the beam position. The spacer sensitivity $\Psi_2$ can be achieved by reducing a dielectric ratio (specific dielectric constant) between the dielectric constant $\in_{sp}$ [F/m] of the spacer and that $\in_{space}$ [F/m] in a nearby space, namely in vacuum, preferably to 40 or less.

The defining of the potential in the direction of height of the spacer by a current field can be divided into a bulk potential defining type of providing a dielectric substrate with an electrical conductivity, and a skin potential defining type of providing an insulating substrate with a high resistance film. The spacer, not being a complete insulator nor having a complete metallic conductivity, shows both a dielectric property and an electroconductivity. The skin potential defining type is advantageous because factors, defining a time constant, for determining a transient response of potential in a creepage surface, are functionally separated. More specifically, the high resistance film serves as a resistance element defining the time constant, and the dielectric constants of the insulating substrate and the surrounding space within the range of electric field serve as an electrostatic capacitance element for defining the time constant. Therefore, the dielectric constant in the entire spacer can be selected low even if an electroconductivity is given to the high resistance film.

More specifically, a high distortion point glass employed as the insulating substrate has a specific dielectric constant of about 7.9 in case of PD200, manufactured by Asahi Glass Co., or about 5.8 in case of borosilicate glass #7059 manufactured by Corning Glass Co. (both being at about room temperature). The specific dielectric constant of the insulating substrate becomes the specific dielectric constant of the spacer, by selecting the thickness of the high resistance film, on the insulating substrate, at about several micrometers or less.

On the other hand, a spacer of bulk defining type may have the equivalent specific dielectric constant of 100 or higher as described in U.S. Pat. No. 6,002,198, and is disadvantageous in suppressing the spacer sensitivity $\Psi_2$. In the present invention, the spacer of bulk defining type preferably has an equivalent specific dielectric constant of 40 or less, more preferably 10 or less.

Also the spacer of skin defining type preferably has a specific dielectric constant of the insulating substrate of 40 or less, more preferably 10 or less and further preferably 6 or less. On the other hand, the high resistance film has a specific dielectric constant of 60 or less, and more preferably 30 or less. A lower limit of the specific dielectric constant of each member is 1.

(f) To Reduce $\Psi_0\times\Psi_2$ $\Psi_0\times\Psi_2$ is preferably 0.05 or less. A value of $\Psi_0\times\Psi_2$ not exceeding 0.05 allows to suppress both sensitivities in the heat resistance design and in the dielectric design of the spacer. As a result, a reduced displacement in the beam position can be realized even in the presence of a front-rear temperature difference in the panel, thereby enabling to provide a field acceleration display of a high quality.

In the following, there will be explained methods of determining parameters in the present invention.

[$\Psi_0 \times \Psi_2$]

A front-rear temperature difference $\Delta T$ of the panel and a displacement $\Delta x$ in the incident position of the electron beam in the vicinity of the spacer, resulting from $\Delta T$, are measured to determine an activation energy Ea of the resistance of the potential defining element in the spacer and an operation temperature thereof, and a height of the spacer is measured. The obtained values are substituted in the general formula (1) to obtain $\Psi_0 \times \Psi_2$. The activation energy is obtained by an Arrhenius plotting of temperature dependence of current/voltage, and determined from a gradient of such plotting. The plotting is made with a logarithmic ordinate representing current/voltage against a linear abscissa indicating a reciprocal of an absolute temperature.

[Spacer Heat Resistance Division Ratio $\Psi_0$]

Method 1:

A temperature difference $\Delta T_1$ between the anode and the cathode is defined utilizing a heater, a Peltier device or the like on both external surfaces of the panel. A heat distribution in the direction of height of the spacer is measured from a lateral side by an infrared radiation thermometer to determine the temperature of the spacer in the contact portions, thereby obtaining $\Delta T_2$. $\Psi_0$ is determined from thus obtained $\Delta T_2/\Delta T_1$.

Method 2:

The temperature difference $\Delta T_2$ in the direction of height of the spacer may be determined by a two-point temperature measurement and by an extrapolation. The two-point temperature measurement is a method of determining a sum of discontinuous temperature differences in the contact portions, by an extrapolation of arbitrary two points aligned in the direction of height. A specific measuring method is shown in FIGS. 12A and 12B, in which shown are substrates 31, 32, 38, a planar heater 33, water-cooled heat sinks 34, 35, and thermocouples 36*a*, 36*b*, 37*a*, 37*b*, 39*a*, 39*b*.

Figure 12A:
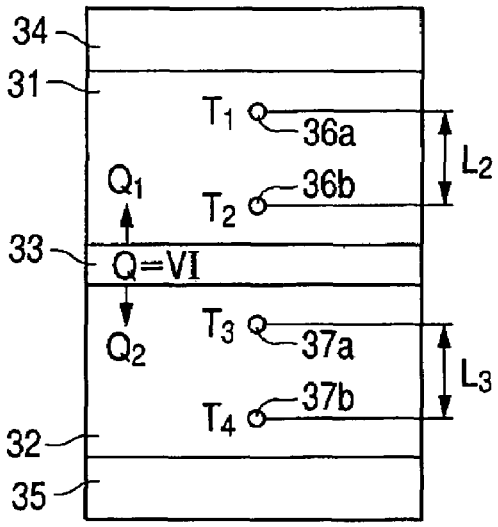
FIGS. 12A and 12B are schematic views showing a method of determining a thermal conductivity of a spacer and a contact face in the present invention.
Figure 12B:
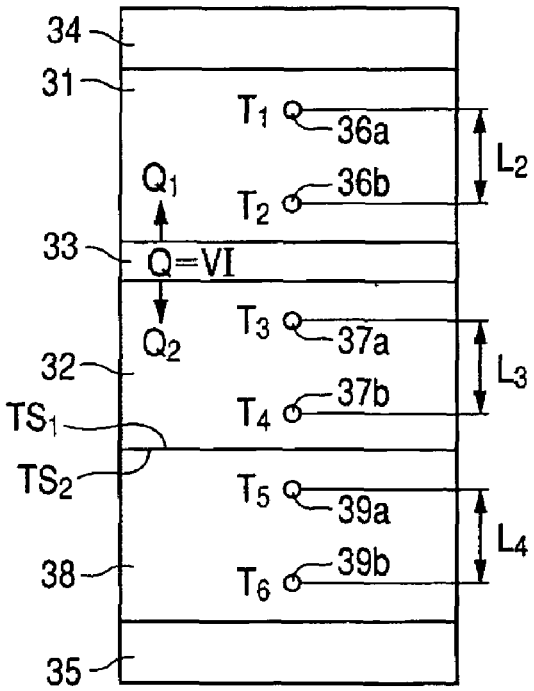

FIG. 12A shows a method of determining a thermal conductivity $\in$ of the spacer for determining the heat resistance $Rh_{sp}$ [$m^2K/W$] of the spacer. A similar method can be employed for determining the heat resistance $Rh_{crp}$ [$m^2K/W$] between the spacer and RP, and the heat resistance $Rh_{cfp}$ [$m^2K/W$] between the spacer and FP.

In case of determining the bulk thermal conductivity, a shape and a dimension of the object can be converted into those easy for measurement. For example, there may be selected a shape enabling easy installation of thermocouple and heater. In FIG. 12A, thermocouples 36*a*, 36*b*, 37*a* and 37*b* are so incorporated as to measure the heat conduction path length in two positions in the vicinity of center of the heat conduction path in the substrates 31, 32 constituting the objects, and a planer heater 33 of a known heat consumption is pinched between the substrates 31 and 32. The substrates 31 and 32 may have mutually different thicknesses. Upper and lower surfaces of the substrates 31 and 32 are sandwiched by water-cooled heat sinks 34, 35 (or Peltier elements). Also the periphery is enclosed by a heat insulation material so as to obtain a zero heat balance except for the heat conduction paths.

In determining the thermal conductivity, the central planar heater is energized so as to obtain a constant heat generation amount Q (=VI) [W]. Also an amount and a temperature of the water supplied to the heat sinks 34, 35 are so regulated that the upper and lower external faces of the substrates have a constant temperature in time. Then temperatures in four thermocouples are measured and used in a following general formula (22) with distances $L_2$, $L_3$ [m] of adjacent thermocouples, wherein S indicates a cross section [$m^2$] in a direction perpendicular to the heat conduction path of the substrates 31, 32:

$$\lambda = \frac{L_2 \times L_3}{L_3(T_2 - T_1) + L_2(T_3 - T_4)} \times \frac{Q}{S} \tag{22}$$

The value $\in$ thus obtained is used for normalizing the heat conduction path length (for example spacer height h) in the actual configuration to determine a heat resistance Rh [$m^2K/W$] of the member. Also a reciprocal 1/Rh of the obtained Rh is a heat conduction rate t [$W/m^2K$].

Now reference is made to FIG. 12B for explaining a defining method for the contact face, wherein shown are a member 38 and thermocouples 39*a*, 39*b*.

As in FIG. 12A, an imaginary member is contacted between RP (or FP) and a spacer as in the contact portion. Also there is prepared a substrate surfacially bearing a metal back, a black matrix or wirings on the RP, which is pressed to the imaginary member with a planar pressure similar to a pressure when a spacer is installed in the vacuum container.

Then a measurement is conducted as in FIG. 12A by providing the substrates 31, 32, 38 with thermocouples 36*a*, 36*b*, 37*a*, 37*b*, 39*a* and 39*b* in two locations. Since the thermal conductivity $\in$ of the substrates 31, 32 is known, a heat amount Q [$W/m^2$] supplied by the heater 33 on one side can be determined. Also based on distances $L_3$, $L_4$ and temperature differences $T_3$-$T_4$ and $T_5$-$T_6$ of the thermocouples 37*a* to 37*b* and 39*a* to 39*b*, temperatures $TS_1$, $TS_2$ [K] of the contact faces of the contemplated members 32, 38 can be determined by an extrapolation. Thus obtained $Q_2$ [$W/m^2$] and $TS_1$, $TS_2$ [K] are used in a following general formula (23) for determining the heat resistance Rh [$m^2K/W$] of the contact faces. A reciprocal of Rh is the thermal conductivity t [$W/m^2K$]:

$$Rh = 1/t = (TS_1 - TS_2)/Q_2 \tag{23}$$

Method 3:

In case the measurement of $\Psi_0$ is difficult because of a difficulty in reproducing the contact state corresponding to the atmospheric pressure or of another restriction, $\Psi_0$ may be determined by the determination of $\Psi_2$ and $\Psi_0 \times \Psi_2$.

[Spacer Sensitivity $\Psi_2$]

A distance sensitivity of a temperature sensitivity, relating to $\Psi_0 \times \Psi_2$ in an electron emitting device in the vicinity of the spacer, is measured, and an attenuation distance x of an influence thereof is determined. Also an electric field influencing range $x_0$ [m] of the spacer to the space close thereto is determined. Based on these, $\alpha$ is established for each device and $\Psi_2$ is determined. An example of determination by this method is shown in FIG. 13.

Figure 13:
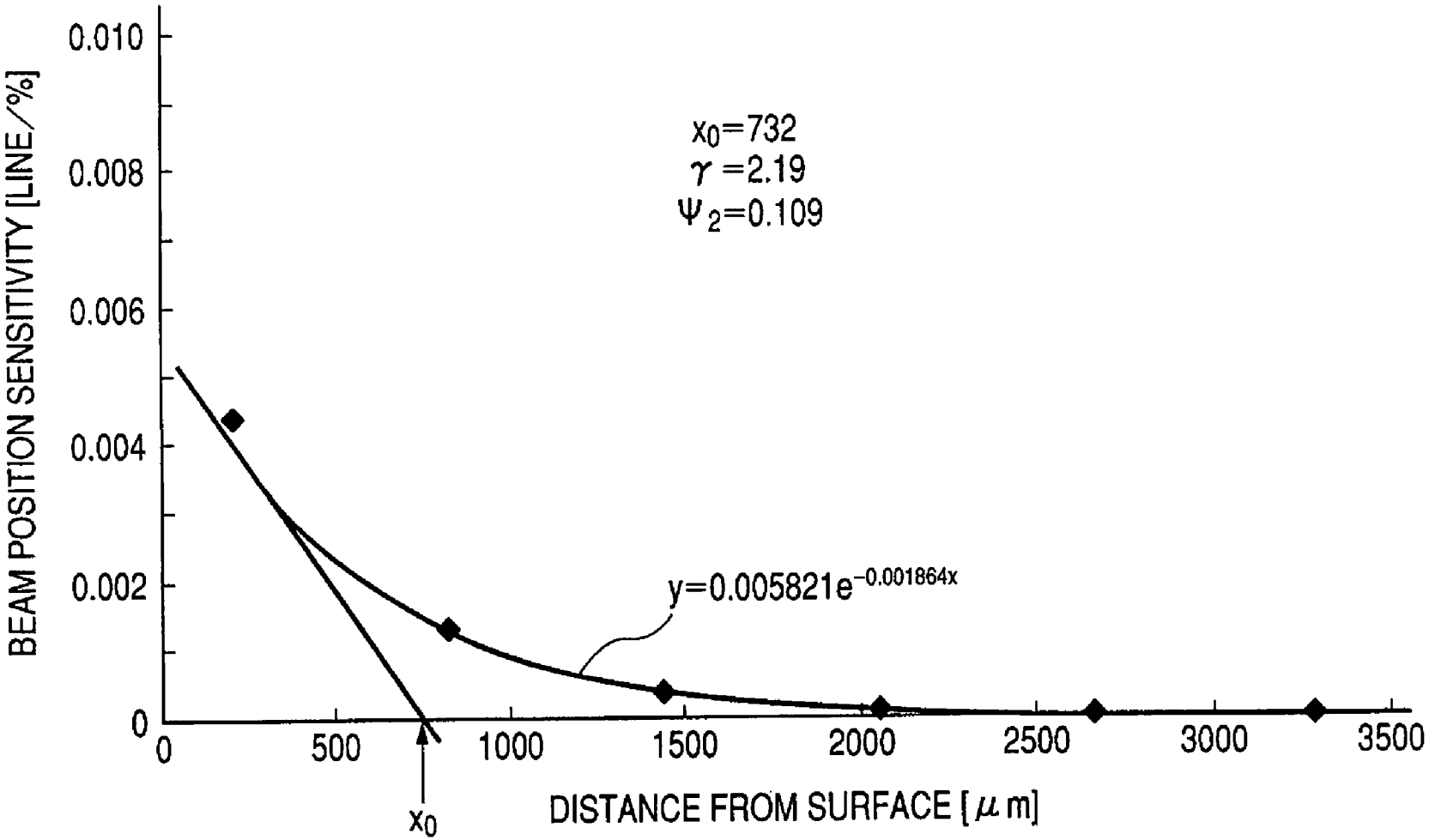
FIG. 13 is a view showing a method of determining a spacer sensitivity in the present invention.

In FIG. 13, the ordinate indicates a sensitivity [line/K] relating to $\Psi_0 \times \Psi_2$, and the abscissa indicates a distance between an arbitrary device and the spacer surface. Because of a generally exponential distance dependence, there is obtained a relation $f(x)=a \times \exp(-x/xr)$, wherein a and xr are constants, which are determined by utilizing a least square method in a model function. The xr thus determined corresponds to the attenuation distance x mentioned above. A value x satisfying a first-order differential equation $f'(x_i)=0$ of the above-determined function f(x) at a distance $x_1$ between a contemplated device (usually closest device having a higher sensitivity) and the spacer provides the electric field influencing distance $x_0$. Finally $\Psi_2$ is determined according to a following general formula (3), utilizing the height h of the spacer.

The aforementioned sensitivity can also be determined by a following method.

It can be determined by normalizing a value, obtained normalizing the beam position Δx of the spacer with the pixel pitch of the display, with $(eEah/kT^2Py)/\Delta T$, which is a value obtained from a known term other than $\Psi_0 \times \Psi_2$ in the general formula (1).

$$\Psi_2 = \gamma/20 = h/20x_0 \quad (3)$$

[Spacer Electric Resistance Division Ratio E]

The spacer electric resistance division ratio is obtained by measuring a contact electrical resistance between the members by an ordinary I-V measurement.

EXAMPLES

Example 1

The display apparatus is similar to that shown in FIG. 14 and will not, therefore, be explained further. As an insulating substrate of the spacer, there was employed PD200 manufactured by Asahi Glass Co., with a thickness t=200 μm, a height h=1600 μm and a length of 900 mm. Such substrate was drawn under heating from a mother glass subjected to a convex and/or a concave treatment, and therefore had convex regions and concave regions on its surface. On such insulating substrate, a high resistance film for potential defining was formed by sputtering, which was conducted utilizing a sintered member of W (tungsten) and Ge (germanium) as a sputtering source and introducing inert gases Ar and $N_2$. At the room temperature, the spacer had a sheet resistance on a lateral face and a contact face with the anode or the cathode, respectively of $2.5\times10^{12}$ Ω/sq and $2\times10^{12}$ Ω/sq. Also an activation energy Ea of the resistance on a lateral face of the spacer was measured as 0.35 eV. Such spacers were bundled facing to lateral surfaces each other. Also, on a partial area at an end portion of FP, an oxide paste constituted of $NaCo_2O_4$ was sintered to form a contact portion at the FP side of a ceramic material of a height of 11 μm. The contact portion at the FP side was so formed that the contact portion has an area ratio of 0.01 to the area of a spacer end. Also on Ag row wirings (scanning lines) on RP, a contact member at the cathode side was formed with the aforementioned ceramic material, with same contact ratio and height by screen printing. A contact ratio $S_{cr}/S_{sp}$ of the cross sections $S_{cr}$ and $S_{sp}$ respectively of the contact member and the spacer in a direction parallel to the face plate and the rear plate was 0.01 both at the sides of FP and RP.

As the light emitting member of FP, there were employed P22 phosphors of R, G and B colors commonly employed in the cathode ray tube. It was confirmed that this phosphor had an effective light emission efficiency of 2% when electrons of 10 keV enter through an Al metal back film of a thickness of 100 nm.

Figure 15:
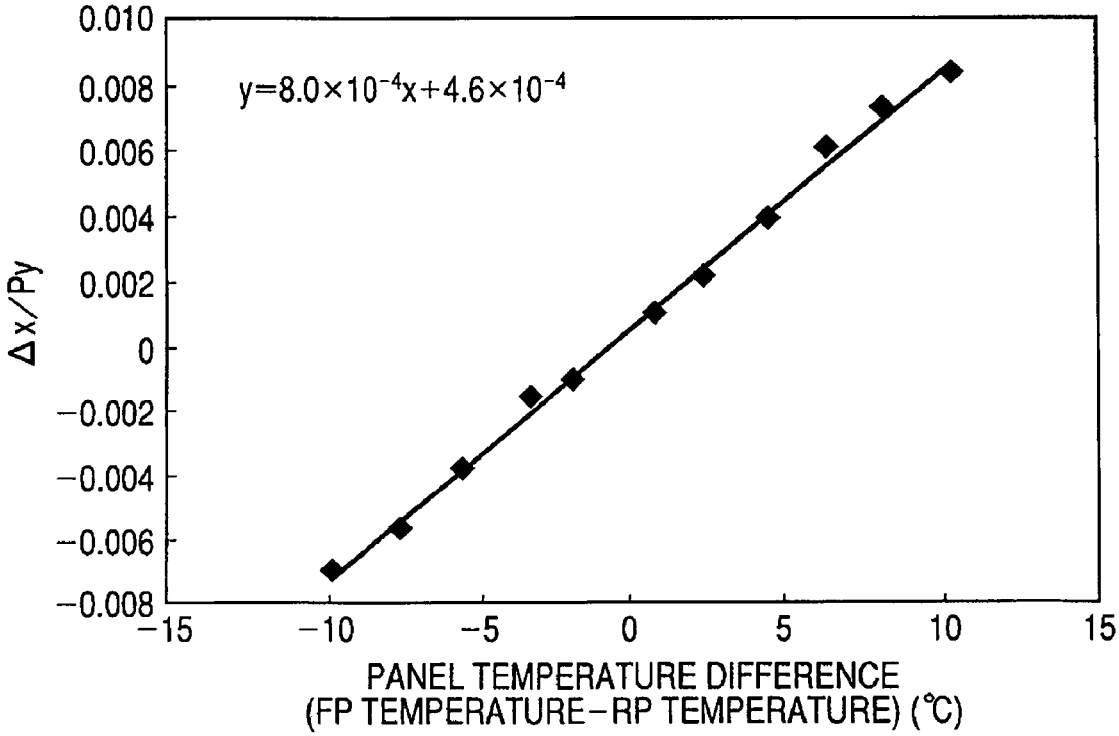
FIG. 15 is a chart showing a temperature dependence of a beam displacement in an embodiment of the present invention.

It was also confirmed that the electron emitting device had an emission efficiency of 3%. The emission efficiency of the electron emitting device is obtained by normalizing the emission current with a sum of the emission current and a driving current of the device. When the electron emitting device was driven under an application of an anode voltage of 10 kV to display a natural moving image, the panel had an average operation temperature ΔT of 50° C. A displacement Δx in the incident position of the electron beam was measured by a CCD camera, and a gradient was determined from the relationship with a front-rear temperature difference $\Delta T_1$ of the panel, as shown in FIG. 15. The obtained characteristics provided, by a least square method, a first-order correlation coefficient of $7.9\times10^{-4}$ [1/° C.]. Also $\Psi_0 \times \Psi_2$ was determined as 0.008 from the height h of the spacer, the activation energy Ea and the average operation temperature T. A beam displacement resulting from the temperature distribution could not be observed visually in the image.

In the measurement of thermal conductivity of the members, the heat resistance $Rh_{crp}$ of cathode, that $Rh_{sp}$ of the spacer and that $Rh_{cfp}$ of the anode were respectively $4.5\times10^{-5}$, $6.9\times10^{-5}$ and $4.0\times10^{-5}$ [$m^2K/W$]. Also $\Psi_0$ was 0.45.

The display employed in this example 1 had a pitch Py of the electron emitting devices (pitch of electron emitting devices in a direction perpendicular to an exposed largest face of the spacer in the display) of 615 μm.

Also an electrical resistance was measured on the spacer and on each contact portion of the contact member at an operation temperature of about 50° C. As a result, the electrical resistance was $1.1\times10^{12}$ [Ω] in the spacer, $1.3\times10^{7}$ [Ω] in the contact member at the side of FP and $1.2\times10^{7}$ [Ω] in the contact member at the side of RP, thus confirming an electrical resistance division ratio E=1 (0.99997).

Example 2

A spacer was installed under same conditions as in Example 1, except that the contact member was changed to an oxide paste constituted of $Ca_{1.95}La_{0.05}Co_{2-x}Al_xO_5$, and a beam displacement was evaluated. As a result, $\Psi_0 \times \Psi_2$ was 0.008 or less, and a beam displacement resulting from the temperature distribution could not be observed visually in the image.

Example 3

A spacer was installed under same conditions as in Example 2, except that the contact member was positioned only on the FP side with a contact rate of 0.8 between the spacer and the Ag wiring at the RP side, and a beam displacement was evaluated. As a result, $\Psi_0 \times \Psi_2$ was 0.015 or less, and a beam displacement resulting from the temperature distribution could not be observed visually in the image.

Example 4

A spacer was installed under same conditions as in Example 1, except that the contact member was constituted of Mn metal and was positioned with a contact rate of 0.001 by an optical patterning and a lift-off process, and a beam displacement was evaluated. As a result, $\Psi_0 \times \Psi_2$ was 0.020 or less, and a beam displacement resulting from the temperature distribution could not be observed visually in the image.

Example 5

A spacer was installed under same conditions as in Example 1, except that the insulating substrate of the spacer was changed to borosilicate glass #7059 manufactured by Corning Glass Co., and a beam displacement was evaluated. As a result, $\Psi_0 \times \Psi_2$ was 0.008 or less, and a beam displacement resulting from the temperature distribution could not be observed visually in the image.

Example 6

An Ag foil of a thickness of 13 μm and an Al foil of a thickness of 13 μm were transferred respectively onto the cathode wiring and the metal back with a contact rate of 0.001 or less, and were patterned by a lift-off process. Also the insulating substrate of the spacer was changed to borosilicate glass #7059 manufactured by Corning Glass Co. A spacer was installed otherwise same conditions as in Example 1, and a beam displacement was evaluated. As a result, $\Psi_0 \times \Psi_2$ was 0.04 or less, and a beam displacement resulting from the temperature distribution could not be observed visually in the image.

Example 7

A spacer was installed under same conditions as in Example 1, except that the high resistance film was changed to a PtAlN film with an activation energy of 0.20 eV and a sheet resistance on a lateral face of $2.6 \times 10^{12}$ Ω/sq at the room temperature, and a beam displacement was evaluated. As a result, $\Psi_0 \times \Psi_2$ was 0.007 or less, and a beam displacement resulting from the temperature distribution could not be observed visually in the image.

Example 8

A spacer was installed under same conditions as in Example 1, except that the insulating substrate was formed by soda lime glass and a continuous $SiO_2$ film of a thickness of 10 μm was formed by sputtering as an undercoat layer under a high resistance WGeN film, and a beam displacement was evaluated. As a result, $\Psi_0 \times \Psi_2$ was 0.04, and a beam displacement resulting from the temperature distribution could not be observed visually in the image.

The present invention allows to satisfactorily suppress a fluctuation in the incident position of the electron beam resulting from a front-rear temperature difference of the panel, and to provide an image forming apparatus capable of a display of a high quality not affected by such temperature difference. Also in the present invention, since a control parameter for suppressing the fluctuation in the incident position of the electron beam is provided outside the spacer, such function can be separated from the functions required for the spacer, thereby facilitating the spacer designing. Therefore, an image forming apparatus of a high reliability can be provided more inexpensively.

This application claims priority from Japanese Patent Application No. 2004-362435 filed on Dec. 15, 2004, which is hereby incorporated by reference herein.

What is claimed is:

1. An image forming apparatus comprising a rear plate having plural electron emitting devices and wirings for applying a voltage to the electron emitting devices, a face plate opposed to the rear plate and having a light emitting member capable of light emission by an irradiation with an electron beam emitted from the electron emitting devices and an anode electrode, a frame member provided between peripheral portions of the rear plate and the face plate and constituting a vacuum container together with the rear plate and the face plate, and a spacer positioned in contact with the rear plate and the face plate and set at a potential defined by a current field, wherein $\Psi_0 \times \Psi_2$ in a following general equation (1) has a positive value not exceeding 0.05:

$$\frac{\Delta x}{Py} = \Psi_0 \times \Psi_2 \left( \frac{eEa}{kT^2} \frac{h}{Py} \right) \Delta T_1 \quad (1)$$

wherein:

Δx: displacement [m] of an incident position of an electron beam in the vicinity of spacer;

Py: pitch [m] of electron emitting devices in a direction perpendicular to a spacer surface;

e: unit charge [C];

Ea: activation energy [eV] of a resistance of a spacer;

h: height of a spacer [m];

k: Boltzmann constant [J/K];

T: average external surface temperature [K] of face plate and rear plate;

$\Psi_0$: heat resistance division ratio of spacer represented by a following general equation (2):

$$\Psi_0 = Rh_{sp}/(Rh_{cfp} + Rh_{sp} + Rh_{crp}) \quad (2)$$

$Rh_{cfp}$: heat resistance between spacer and face plate [$m^2K/W$];

$Rh_{sp}$: heat resistance of spacer [$m^2K/W$];

$Rh_{crp}$: heat resistance between spacer and rear plate [$m^2K/W$];

$\Psi_2$: spacer sensitivity represented by a following general equation (3):

$$\Psi_2 = \gamma/20 \quad (3)$$

γ: spacer field influence coefficient represented by $h/x_0$;

$x_0$: influence range of spacer electric field [m].

2. An image forming apparatus according to claim 1, wherein the spacer heat resistance division ratio $\Psi_2$ has a positive value not exceeding 0.5.

3. An image forming apparatus according to claim 1, wherein the spacer sensitivity $\Psi_2$ has a positive value not exceeding 0.25.

4. An image forming apparatus according to claim 3, wherein a ratio between a dielectric constant $\in_{sp}$ [F/m] of the spacer and a dielectric constant $\in_{space}$ [F/m] in a vacuum space in the apparatus is 40 or less.

5. An image forming apparatus according to claim 1, wherein the spacer heat resistance division ratio $\Psi_0$ and a spacer electric resistance division ratio E represented by a following general formula (4) satisfy a relation $0 < \Psi_0 < E < 1$:

$$E = Re_{sp}/(Re_{cfp} + Re_{sp} + Re_{crp}) \quad (4)$$

wherein:

$Re_{cfp}$: electrical resistance between spacer and face plate [Ω];

$Re_{sp}$: electrical resistance of spacer [Ω]; and $Re_{crp}$: electrical resistance between spacer and rear plate [Ω].

6. An image forming apparatus comprising a rear plate having plural electron emitting devices and wirings for applying a voltage to the electron emitting devices, a face plate opposed to the rear plate and having a light emitting member capable of light emission by an irradiation with an electron beam emitted from the electron emitting devices and an anode electrode, a frame member provided between peripheral portions of the rear plate and the face plate and constituting a vacuum container together with the rear plate and the face plate, and a spacer positioned in contact with the rear plate and the face plate and set at a potential defined by a current field, wherein a spacer heat resistance division ratio $\Psi_0$ represented by a following general equation (2) has a positive value not exceeding 0.5:

$$\Psi_0 = Rh_{sp}/(Rh_{cfp}+Rh_{sp}+Rh_{crp}) \quad (2)$$

wherein:

$Rh_{cfp}$: heat resistance between spacer and face plate [$m^2K/W$];

$Rh_{sp}$: heat resistance of spacer [$m^2K/W$];

$Rh_{crp}$: heat resistance between spacer and rear plate [$m^2K/W$].

7. An image forming apparatus comprising a rear plate having plural electron emitting devices and wirings for applying a voltage to the electron emitting devices, a face plate opposed to the rear plate and having a light emitting member capable of light emission by an irradiation with an electron beam emitted from the electron emitting devices and an anode electrode, a frame member provided between peripheral portions of the rear plate and the face plate and constituting a vacuum container together with the rear plate and the face plate, and a spacer positioned in contact with the rear plate and the face plate and set at a potential defined by a current field, wherein a spacer heat resistance division ratio $\Psi_0$ represented by a following general equation (2) and a spacer electric resistance division ratio B satisfy a relation $0<\Psi_0<E<1$:

$$\Psi_0 = Rh_{sp}/(Rh_{cfp}+Rh_{sp}+Rh_{crp}) \quad (2)$$

wherein:

$Rh_{cfp}$: heat resistance between spacer and face plate [$m^2K/W$];

$Rh_{sp}$: heat resistance of spacer [$m^2K/W$]; and $Rh_{crp}$: heat resistance between spacer and rear plate [$m^2K/W$];

$$E = Re_{sp}/(Re_{cfp}+Re_{sp}+Re_{crp}) \quad (4)$$

wherein:

$Re_{cfp}$: electrical resistance between spacer and face plate [Ω];

$Re_{sp}$: electrical resistance of spacer [Ω]; and $Re_{crp}$: electrical resistance between spacer and rear plate [Ω].

8. An image forming apparatus according to claim 7, wherein the spacer heat resistance division ratio $\Psi_0$ has a positive value not exceeding 0.5.

9. An image forming apparatus according to claim 1, wherein the spacer is formed by a substrate having a specific dielectric constant of 40 or less.

10. An image forming apparatus according to claim 1, wherein the spacer is formed by covering a surface of an insulating substrate with a high resistance film of a resistance lower than that of the substrate, the insulating substrate has a specific dielectric constant of 40 or less and the high resistance film has a specific dielectric constant of 60 or less.

11. An image forming apparatus according to claim 9, further comprising a contact member in at least either of contact faces of the spacer with the face plate or the rear plate.

12. An image forming apparatus according to claim 11, wherein the contact member is formed by a thermoelectric converting material.

13. An image forming apparatus according to claim 12, wherein the thermoelectric converting material has a Seebeck coefficient of 3 or higher.

14. An image forming apparatus according to claim 13, wherein the thermoelectric converting material is formed by a Te-containing alloy or a oxide with strong electron-correlation effects.

15. An image forming apparatus according to claim 14, wherein the Te-containing alloy is $AgPbBiTe_3$, $Bi_2Te_3$, PbTe or $Sb_2Te_3$.

16. An image forming apparatus according to claim 14, wherein the oxide with strong electron-correlation effects is a laminar cobalt oxide.

17. An image forming apparatus according to claim 14, wherein the oxide with strong electron-correlation effects is $Na_{1.2}Co_{2-x}Cu_xO_4$, $NaCl_2O_4$, or $Ca_{1.95}La_{0.05}Co_{2-x}Al_xO_5$.

18. An image forming apparatus according to claim 1, wherein a ratio $S_{cr}/S_{sp}$, between cross sectional areas $S_{cr}$ and $S_{sp}$ respectively of the contact member and the spacer in a direction parallel to the face plate and the rear plate, is 0.05 or less.

* * * * *

UNITED STATES PATENT AND TRADEMARK OFFICE

CERTIFICATE OF CORRECTION

PATENT NO. : 7,262,548 B2
APPLICATION NO. : 11/289698
DATED : August 28, 2007
INVENTOR(S) : Nobuhiro Ito It is certified that error appears in the above-identified patent and that said Letters Patent is hereby corrected as shown below:

ON TITLE PAGE AT ITEM (75) INVENTOR

"Nobuhiro Ito, Kanagawa-Ken (JP)" should read --Nobuhiro Ito, Yamato (JP)--.

ON TITLE PAGE AT ITEM (57) ABSTRACT

Line 8, "conduction," should read --conduction--.

COLUMN 1

Line 42, "circuit etc.," should read --circuit, etc.;--;
Line 43, "phosphor," should read --phosphor;--;
Line 45, "panel," should read --panel;--; and
Line 50, "through" should read --though--.

COLUMN 2

Line 10, "meet" should read --meet the--.

COLUMN 6

Line 9, "plate" should read --place--; and
Line 48, "of" should read --of a--.

COLUMN 7

Line 13, "$q = \sigma\psi 4$" should read --$q = \sigma T4$--;
Line 26, "on" should read --on the--;
Line 38, "area I" should read --area i--;
Line 46, "from" should read --from the--; and
Line 48, "radiation:" should read --radiation;--.

Signed and Sealed this

Ninth Day of November, 2010

David J. Kappos

David J. Kappos
*Director of the United States Patent and Trademark Office*

COLUMN 8

Line 3, "FIGS 3," should read --FIG. 3, reference numerals--.

COLUMN 10

General Formula (10), "(Step 4)" should be deleted.
Line 9, "A dependence" should read --(Step 4) ¶ A dependence--;
Line 11, "an" should read --a--;
Line 13, "in" should be deleted--;
Line 16, "has" should read --has the--.

COLUMN 11

General formula (13), "(Steps 5, 6)" should be deleted.
Line 46, "A potential" should read --(Steps 5, 6) ¶ A potential--.

COLUMN 12

Line 3, "of" (third occurrence) should read --of the--; and
Line 7, "$\gamma h = \gamma x_0$." should read -- $\gamma$
$h = \gamma x_0$.--.

COLUMN 13

Line 8, "range" should read --rate--; and
Line 9, "range" should read --rate--.

COLUMN 14

Line 15, "within" should read --within the--; and
Line 57, "result" should read --results--.

COLUMN 15

Line 15, "pro" should read --provided--.

COLUMN 16

Line 1, "vided" should be deleted.

COLUMN 17

Line 39, "portions" should read --portion--.

COLUMN 19

Line 52, "planer" should read --planar--.

COLUMN 20

Line 61, "$(x_i)=0$" should read --$(x_1)=0$--.

COLUMN 21

Line 3, "obtained" should read --obtained by--; and
Line 35, "surfaces" should read --surfaces of--.

COLUMN 22

Line 1, "[1/° C.]." should read --[1/°C ].--.

COLUMN 23

Line 9, "installed" should read --installed under--;

COLUMN 24

Line 34, claim 2 "ratio $\psi_2$" should read --ratio $\psi_0$--.

COLUMN 25

Line 23 claim 7, "ratio B" should read --ratio E--.

COLUMN 26

Line 24 claim 14, "a" should read --an--; and
Line 37 claim 18, "cross sectional" should read --cross-sectional--.